US010245858B2

(12) United States Patent
Okawa et al.

(10) Patent No.: US 10,245,858 B2
(45) Date of Patent: Apr. 2, 2019

(54) PRINTING APPARATUS

(71) Applicant: SEIKO EPSON CORPORATION, Tokyo (JP)

(72) Inventors: Soshi Okawa, Shiojiri (JP); Kazuhiro Nishiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/847,161

(22) Filed: Dec. 19, 2017

(65) Prior Publication Data

US 2018/0178559 A1 Jun. 28, 2018

(30) Foreign Application Priority Data

Dec. 27, 2016 (JP) ..... 2016-254411

(51) Int. Cl.

| | |
|---|---|
| ***B41J 13/02*** | (2006.01) |
| ***B41J 13/03*** | (2006.01) |
| ***B41J 13/00*** | (2006.01) |
| ***B41J 2/01*** | (2006.01) |
| ***B41J 13/10*** | (2006.01) |

(52) U.S. Cl.

CPC ..... *B41J 13/025* (2013.01); *B41J 2/01* (2013.01); *B41J 13/0036* (2013.01); *B41J 13/03* (2013.01); *B41J 13/103* (2013.01); *B65H 2301/42134* (2013.01)

(58) Field of Classification Search

CPC . B41J 13/025; B41J 13/103; B41J 2/01; B41J 13/03; B41J 13/0036; B65H 2301/42134

See application file for complete search history.

(56) References Cited

U.S. PATENT DOCUMENTS

| | | | | |
|---|---|---|---|---|
| 6,994,341 | B2 * | 2/2006 | Aoki | B65H 1/18 271/117 |
| 8,430,394 | B2 * | 4/2013 | Uehara | B65H 1/266 271/117 |
| 8,695,965 | B2 * | 4/2014 | Shin | B65H 1/266 271/121 |

FOREIGN PATENT DOCUMENTS

| | | |
|---|---|---|
| JP | 2015-093762 | 5/2015 |

* cited by examiner

*Primary Examiner* — Justin Seo

(74) *Attorney, Agent, or Firm* — Workman Nydegger

(57) ABSTRACT

A printing apparatus is provided which is capable of reducing a concern that a medium may remain inside an apparatus main body at the time of pulling out a medium accommodating member.

5 Claims, 16 Drawing Sheets

PRINTING APPARATUS

BACKGROUND

1. Technical Field

The present invention relates to a printing apparatus such as an ink jet type printer.

2. Related Art

From the related art, as an example of a printing apparatus, an ink jet type printer performing printing on paper, which is as an example of a medium, by ejecting ink, which is an example of liquid, is known. As such a printer, a printer provided with a cassette (medium accommodating member) which is detachably provided in an apparatus main body, a pickup roller which takes out the medium being accommodated in the cassette, and a paper feed roller and a retard roller which pinch and transport the medium taken out by the pickup roller is known. In the cassette, a lifting plate (an example of a hopper) is disposed in which the medium is mounted on an upper surface thereof and which can be variably positioned between a first position which is along a bottom portion of the cassette and a second position which is above the first position and at which an end portion on a downstream side in a transporting direction of the medium, at the uppermost position among the mediums being accommodated in a sheet accommodating portion is brought into contact with the pickup roller. Also, in JP-A-2015-93762, a printer which is provided with a contacting and separating mechanism for separating a retard roller from a paper feed roller at the time of pulling out the cassette is disclosed. The contacting and separating mechanism suppresses paper remaining inside the apparatus main body at the time of pulling out the cassette by releasing the paper pinched by the paper feed roller and the retard roller.

However, in such a printer, even when the medium pinched by the paper feed roller and the retard roller is released at the time of pulling out the cassette, the end portion on a downstream side in the transporting direction of the medium, at the uppermost position inside the cassette is pressed by the pickup roller. Therefore, at the time of pulling out the cassette, the medium may remain inside the apparatus main body due to a friction resistance between the medium pressed by the pickup roller and the pickup roller.

SUMMARY

An advantage of some aspects of the invention is to provide a printing apparatus capable of reducing a concern that a medium may remain inside an apparatus main body at the time of pulling out a medium accommodating member.

Hereinafter, means of the invention and operation effects thereof will be described.

According to an aspect of the invention is provided a printing apparatus including an apparatus main body, a printing unit that performs printing on a medium, a medium accommodating member that is detachably provided in the apparatus main body and is capable of accommodating the medium, a first roller that is provided in the apparatus main body, and picks up the medium from the medium accommodating member by being brought in contact with the medium which is accommodated in the medium accommodating member mounted in the apparatus main body and being driven to rotate, a second roller that is provided in the apparatus main body, is disposed on a downstream side of the first roller in a transporting direction of the medium, and is brought into contact with the medium picked up by the first roller on the same surface as a surface with which the first roller comes into contact and is driven to rotate, a third roller that is provided in the apparatus main body, and is brought into contact with the medium picked up by the first roller on a surface opposite to the surface with which the first roller comes into contact and is rotated following the second roller, a driving source of the first roller and the second roller, and a displacing mechanism that displaces a position of the third roller with respect to the second roller depending on attaching and detaching of the medium accommodating member to and from the apparatus main body, in which the medium accommodating member includes a hopper which is movable between a feeding position in which the medium to be accommodated is pressed to the first roller by a pressing force of a pressing member and a standby position in which the medium is separated from the first roller against the pressing force of the pressing member, the displacing mechanism displaces the third roller to a contacting position in which the third roller is capable of coming into contact with the second roller when the medium accommodating member is mounted in the apparatus main body, and displaces the third roller to a non contacting position in which the third roller is separated from the second roller when the medium accommodating member is pulled out from the apparatus main body, and the first roller is rotatable in a reverse rotating direction opposite to a rotating direction of the driven rotation due to the frictional force with the pulled out medium in accordance with the pulling-out of the medium accommodating member under a circumstance in which the medium is pressed by the hopper present at the feeding position.

In the configuration, at the time of pulling out the medium accommodating member from the apparatus main body, the first roller which presses the medium from the lower side by the hopper of the medium accommodating member is reversely rotated due to the frictional force with the pulled out medium in accordance with pulling-out the medium accommodating member. Therefore, the medium pressed by the first roller can be pulled out from the apparatus main body with the medium accommodating member. Accordingly, a concern that the medium may remain inside the apparatus main body at the time of pulling out the medium accommodating member can be reduced.

In the printing apparatus, it is preferable that a driving force of the driving source be transmitted through an allowing portion which allows the first roller to be rotated in the reverse rotating direction.

In the configuration, when the first roller is reversely rotated by the allowing portion, a concern that the medium may remain inside the apparatus main body can be reduced.

In the printing apparatus, it is preferable that a transmitting mechanism that includes a first engaging portion for transmitting the driving force of the driving source to the first roller and a gear that includes a second engaging portion which is engaged with the first engaging portion and transmits the driving force of the driving source to the first roller be further included, in which the allowing portion be a gap in the rotating direction of the gear when the first engaging portion and the second engaging portion are engaged with each other.

In the configuration, compared to a configuration in which the allowing portion is provided inside the transmitting mechanism, a structure of the transmitting mechanism can be easily formed.

In the printing apparatus, it is preferable that the apparatus main body include a cam which displaces the hopper toward the standby position against a pressing force of the pressing member by a part of the hopper coming into contact with the cam when the medium accommodating member is pulled out from the apparatus main body, and the cam be provided so that the part of the hopper comes into contact with the cam after the third roller is displaced to a non contacting position by the displacing mechanism when the medium accommodating member is pulled out from the apparatus main body.

In the configuration, at the time of pulling out the medium accommodating member from the apparatus main body, after the third roller is displaced to the non contacting position, the hopper is displaced toward the standby position. Therefore, in a process in which the medium pinched by the second roller and the third roller is released, the medium is pressed against the first roller by the hopper. That is, at the time of pulling out the medium accommodating member from the apparatus main body, since the first roller is reversely rotated in accordance with contacting of the medium which is released from being pinched by the second roller and the third roller and is moved, the medium can be easily pulled out between the second roller and the third roller.

In the printing apparatus, it is preferable that a fourth roller that is disposed closer to a side where the medium accommodating member is pulled out than the first roller, and is capable of coming into contact with the medium biased by the hopper on the same surface as the surface with which the first roller comes in contact be further included, and a distance in a vertical direction from a part in which the medium comes into contact with the fourth roller to a bottom wall of the medium accommodating member be longer than a distance in the vertical direction from a part in which the medium comes into contact with the first roller to the bottom wall.

In the configuration, in a case in which a lot of mediums are accommodated in the medium accommodating member, even when the medium is deviated from the first roller in an attaching and detaching direction of the medium accommodating member and is not pressed by the first roller, the medium is pressed by the fourth roller. Therefore, at the time of pulling out the medium accommodating member from the apparatus main body, a concern that the medium which is pushed up by the hopper may come into contact with the other members can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of an ink jet type printer which is a type of a printing apparatus will be described with reference to drawings.

Figure 1:
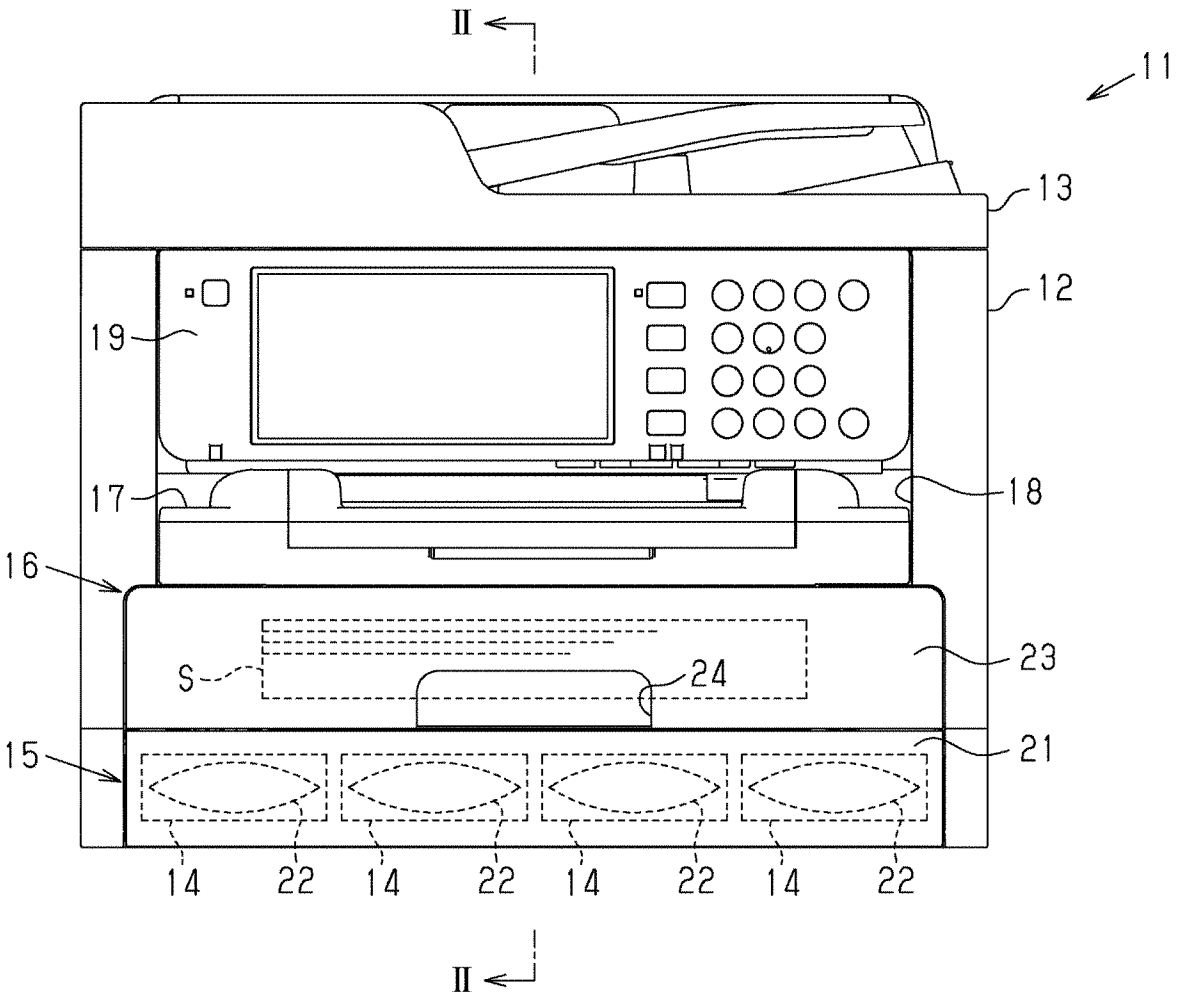
FIG. 1 is a front view schematically illustrating an embodiment of a printing apparatus.

As illustrated in FIG. 1, a printing apparatus 11 is provided with an apparatus main body 12 in a rectangular parallelepiped shape, and a reading unit 13 which is attached to an upper portion thereof. The reading unit 13 is capable of reading images such as letters or photos recorded on an original document. Inside the apparatus main body 12, a mounting portion 15 in which a container 14 is detachably mounted, a medium accommodating portion 16 capable of accommodating the medium (for example, paper) S are sequentially disposed from a bottom portion side which is a lower side toward an upper portion in a vertical direction. In addition, a spout 18 to which a discharging tray 17 in which the printed medium S is discharged extends, and an operating portion 19 for operating the printing apparatus 11 are disposed above the medium accommodating portion 16 on a front surface of the apparatus main body 12. Also, the front surface of the apparatus main body 12 has a height and a width and indicates a side surface which mainly performs operations with respect to the printing apparatus 11.

The mounting portion 15 is covered with a front cover 21 which constitutes a part of the front surface of the apparatus main body 12 and is rotatable. The mounting portion 15 is capable of mounting one or a plurality of (four in this embodiment) the containers 14. Liquid accommodating members 22 for accommodating liquid being used by the printing apparatus 11 for performing printing on the medium S are detachably mounted in the containers 14. The liquid accommodating members 22 respectively accommodates different types of liquid (for example, inks having different colors such as black, cyan, magenta, and yellow). In addition, the container 14 is detachably mounted in the mounting portion 15 even when the container is a single member which does not include the liquid accommodating member 22. Also, the mounting portion 15 may be configured to be capable of directly mounting the liquid accommodating member 22 without the container 14. In the embodiment, a direction intersecting a movement passage when the container 14 is mounted in the mounting portion 15 is set as a width direction of the printing apparatus 11, and a direction where the movement passage extends is set as a depth direction of the printing apparatus 11.

The medium accommodating portion 16 detachably includes the medium accommodating member 23 capable of accommodating the medium S. That is, the medium accommodating member 23 is detachable from the apparatus main body 12. The medium accommodating member 23 accommodates the medium S before the printing apparatus 11 performs printing thereon. The front surface of the medium accommodating member 23 is provided with a handholding portion 24 that a user can handhold. The front surface of the medium accommodating member 23 constitutes a part of the front surface of the apparatus main body 12 when the medium accommodating member 23 is mounted in the apparatus main body 12. In the embodiment, a direction where the movement passage extends when the medium accommodating member 23 is mounted in the medium accommodating portion 16 is the same direction as a direction where the movement passage extends when the container 14 is mounted in the mounting portion 15. Therefore, a mounting direction when the medium accommodating member 23 is mounted in the apparatus main body 12 coincides with a depth direction of the printing apparatus 11. Meanwhile, a pulling-out direction when the medium accommodating member 23 is pulled out from the apparatus main body 12 is a direction opposite to the depth direction of the printing apparatus 11. In short, when the medium accommodating member 23 is mounted in the apparatus main body 12, the medium accommodating member 23 moves from a front side, which is a front surface side of the printing apparatus 11, toward a depth side which is a rear surface side of the printing apparatus 11. In addition, at the time of pulling out the medium accommodating member 23 from the apparatus main body 12, the medium accommodating member 23 moves from the depth side of the printing apparatus 11 toward the front side. Also, in the embodiment, the pulling-out direction, the width direction, and the vertical direction of the printing apparatus 11 respectively indicate different directions.

Figure 2:
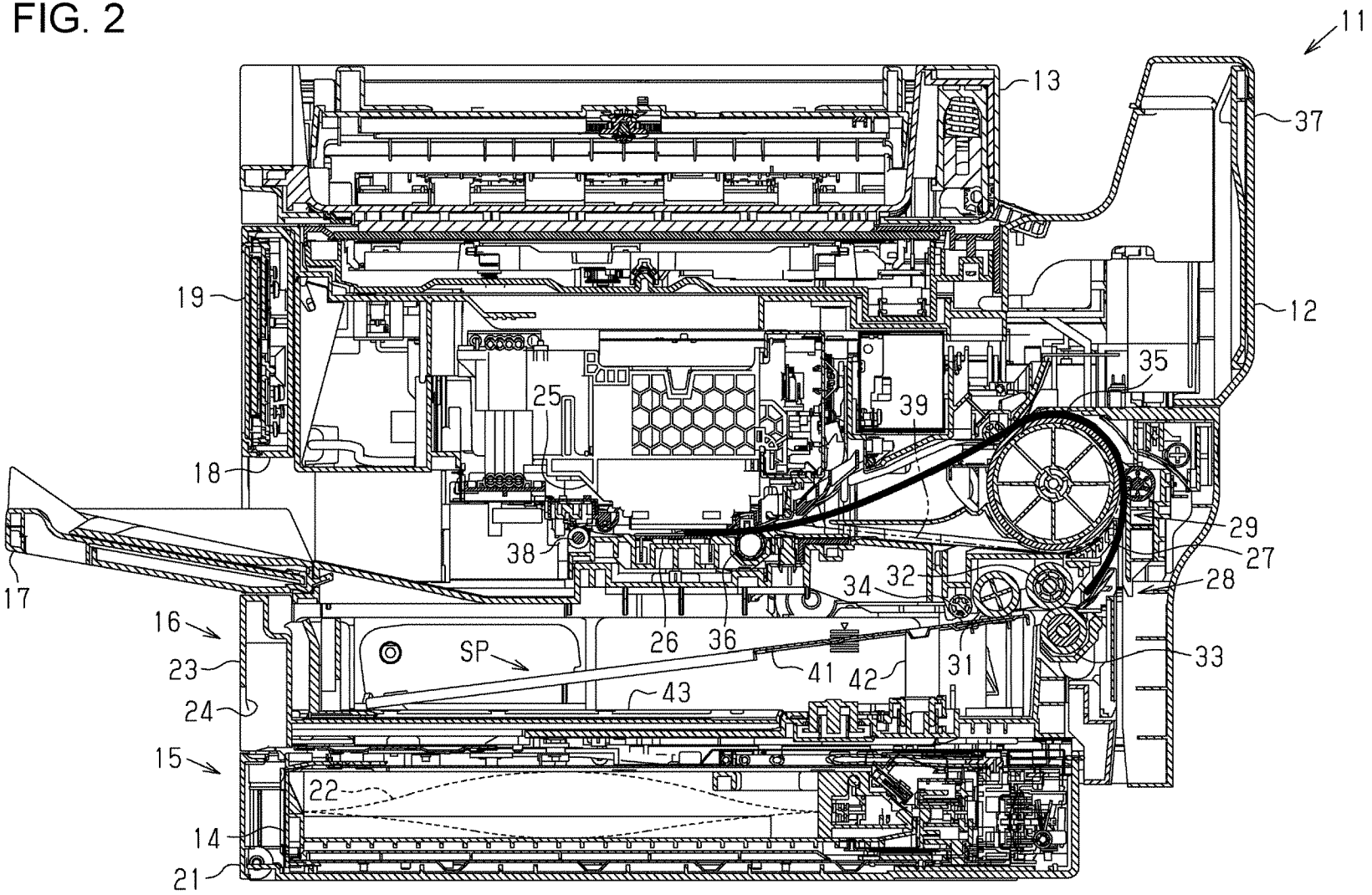
FIG. 2 is a sectional view taken along II-II line in FIG. 1.

As illustrated in FIG. 2, the apparatus main body 12 includes a printing unit 25 and a medium supporting portion 26 at a position above the medium accommodating portion 16. The printing unit 25 is connected to the liquid accommodating member 22 mounted in the mounting portion 15, and performs printing on the medium S by using (ejecting) liquid being supplied from the liquid accommodating member 22. The medium supporting portion 26 is disposed so as to face the printing unit 25, and supports the medium S printed by the printing unit 25 from the lower side.

In addition, the apparatus main body 12 includes a transporting passage 27 extending from the medium accommodating portion 16 toward the printing unit 25, a feeding portion 28 which transports the medium S being accommodated in the medium accommodating member 23 mounted in the medium accommodating portion 16 to the transporting passage 27, and a transporting portion 29 which transports the medium S being transported by the feeding portion 28 along the transporting passage 27. After the transporting passage 27 extends from a rear side toward an upper side of the medium accommodating portion 16, the transporting passage bents toward a front side of the printing apparatus 11, and extends to a position between the printing unit 25 and the medium supporting portion 26.

The feeding portion 28 includes a pickup roller 31 as a first roller which takes out the medium S from the medium accommodating member 23 by being rotated in a state of being in contact with the medium S accommodated in the medium accommodating member 23 mounted the medium accommodating portion 16. In addition, the feeding portion 28 includes a separating roller 32 as a second roller which transports the medium S toward the printing unit 25 by being rotated in a state of pinching the medium S taken out from the medium accommodating member 23 due to rotating the pickup roller 31, and a retard roller 33 as a third roller. In addition, the feeding portion 28 includes a pressing roller 34 as a fourth roller capable of coming into contact with the medium S being accommodated in the medium accommodating member 23 from the upper side when the medium accommodating member 23 is pulled out from the medium accommodating portion 16.

The pickup roller 31 is disposed on an end portion which is the depth side of the medium accommodating member 23 mounted in the medium accommodating portion 16 in the depth direction. The pickup roller 31 takes out the medium S from the medium accommodating member 23 by being rotated in a forward rotating direction which is a counterclockwise direction in FIG. 2. The separating roller 32 and the retard roller 33 are disposed on a depth side of the pickup roller 31 in the depth direction, and face each other so as to pinch the medium S. Here, the separating roller 32 is a roller which comes into contact with the same surface as a surface of the medium S with which the pickup roller 31 comes into contact, and the retard roller 33 is a roller which comes into contact with an opposite surface thereto. That is, the retard roller 33 is positioned under the separating roller 32. Also, the retard roller 33 is a roller which is rotated following in accordance with rotation of the separating roller 32. In addition, the retard roller 33 is configured to have a higher coefficient of friction with respect to the medium S than that of the separating roller 32. Also, the separating roller 32 and the retard roller 33 separate and transport the medium S one by one due to a different of the coefficients of friction. The pressing roller 34 is disposed on an opposite side of a side on which the separating roller 32 and the retard roller 33 are positioned with respect to the pickup roller 31, that is, on the front side of the pickup roller 31 in the depth direction. Also, the pressing roller 34 is disposed at a position further distant away from the pickup roller 31 than a hopper 41 present at a feeding position. Therefore, in a state in which the hopper 41 present at the feeding position, when the medium S on the hopper 41 is pressed by the pickup roller 31, the pressing roller 34 becomes separated from the medium S. That is, in the vertical direction in a case in which the apparatus main body 12 is provided on a horizontal surface, a distance from a part of the medium S in contact with the pressing roller 34 to a bottom wall 43 of the medium accommodating member 23 is longer than a distance from a part of the medium S in contact with the pickup roller 31 to the bottom wall 43 of the medium accommodating member 23.

The transporting portion 29 includes a plurality of rollers disposed along the transporting passage 27. In the embodiment, a feed roller 35 and a transporting roller 36 are sequentially disposed from an upstream side in the transporting passage 27. Also, the transporting portion 29 may include rollers other than the feed roller 35 and the transporting roller 36. In a case of this embodiment, the feed roller 35 is disposed directly on the separating roller 32. The feed roller 35 transports the medium S transported by the feeding portion 28 along the transporting passage 27 while the medium is bent from an upper side toward a front side. Also, the feed roller 35 transports the medium S which manually fed by a manual feeding portion 37 disposed on a rear side and an upper side of the apparatus main body 12 along the transporting passage 27. The transporting roller 36 is provided at a position near a downstream side in the transporting passage 27, and is disposed to be adjacent to the medium supporting portion 26. The transporting roller 36 transports the medium S transported by the feed roller 35 to a front side along the transporting passage 27.

The transporting portion 29 transports the medium S taken out from the medium accommodating portion 16 by the pickup roller 31 onto the medium supporting portion 26 disposed in a downstream side of the transporting passage 27. At this time, when the medium S is taken out from the medium accommodating portion 16 toward a rear side, the medium is transported to the front side by being bent toward the medium supporting portion 26, and thus a posture thereof is reversed up and down at the time of being positioned on the medium accommodating portion 16 and at the time of being positioned on the medium supporting portion 26. In addition, a width direction of the transported medium S is a direction coincide with a width direction of the printing apparatus 11. Also, the medium S which is completed to be printed by the printing unit 25 is discharged toward the discharging tray 17 by a discharging portion 38 disposed on a front side of the printing unit 25 inside the apparatus main body 12.

Also, the transporting roller 36 can be rotated in both directions of a forward direction and a reverse rotating direction. In a case in which printing is performed on both surfaces of the medium S, the medium S in which printing is performed on one surface thereof is reversely transported by the transporting roller 36 which is reversely rotated. At this time, the medium S is transported on a double-sided printing passage 39 different from the transporting passage 27. The double-sided printing passage 39 extends toward a lower side of the feed roller 35 from the transporting roller 36 in the apparatus main body 12. Also, the medium S transported on the double-sided printing passage 39 returns to the transporting passage 27, and is transported again toward the printing unit 25 while the posture thereof is reversed.

The medium accommodating member 23 mounted in the medium accommodating portion 16 includes the hopper 41 for pushing up the medium S to be accommodated. The hopper 41 is provided in a plate shape, and for example, is biased (pressed) from a lower side toward an upper side by a biasing member (pressing member) 42 constituted of a spring, a rubber, or the like. The biasing member 42 is provided between the hopper 41 and the bottom wall 43 of the medium accommodating member 23, and is disposed at a position near the depth side thereof in the depth direction. Also, the hopper 41 is configured to push up an end portion which is the depth side floats based on an end portion which is the front side in the depth direction by the biasing member 42. That is, in the medium S being accommodated in the medium accommodating member 23, a distal end of the depth side thereof is pushed up by the hopper 41, and is pressed by the pickup roller 31 from a lower side. Also, the medium S pushed up by the hopper 41 of the medium accommodating member 23 is taken out from the medium accommodating member 23 by rotation of the pickup roller 31.

Figure 3:
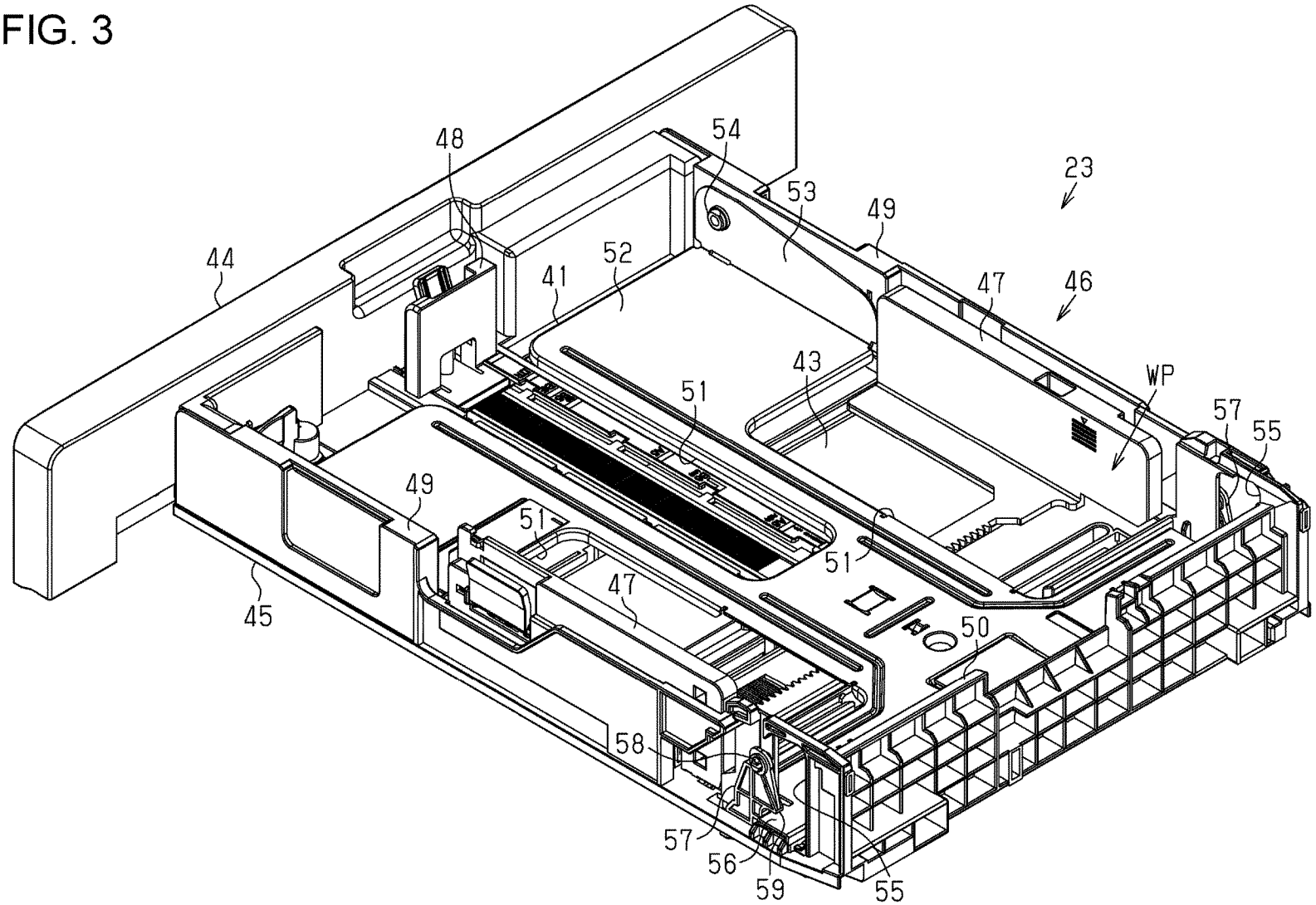
FIG. 3 is a perspective view of a medium accommodating member.

The hopper 41 in the embodiment can be moved vertically between a feeding position SP in which an end portion which is the depth side in the depth direction is positioned on an upper side and the standby position WP in which the end portion is positioned on a lower side so as to move along the bottom wall 43 of the medium accommodating member 23 (refer to FIG. 3). The hopper 41 illustrated in FIG. 2 is positioned at the feeding position SP. The feeding position SP is a position for pressing the medium S being accommodated in the medium accommodating member 23 by the pickup roller 31. The biasing member 42 is always upwardly biased so that the hopper 41 is positioned at the feeding position SP.

As illustrated in FIG. 3, the medium accommodating member 23 includes an operating plate 44 including the handholding portion 24 and a case body 45 which is attached to the operating plate 44. The operating plate 44 is a member for operating the medium accommodating member 23 due to a user by handholding the handholding portion 24, at the time of attaching and detaching the medium accommodating member 23 to and from the apparatus main body 12. The operating plate 44 extends in the width direction so as to have a plate shaped, and a length thereof is longer than the case body 45 in the width direction. The case body 45 is provided in a box shape in which an upper portion is opened, and is capable of accommodating the medium S therein. The case body 45 is provided on a rear surface opposite to the front surface of the operating plate 44 in which the handholding portion 24 is provided, and is provided to extend from a rear surface of the operating plate 44 toward the depth side in the depth direction.

In the case body 45, an edge guide 46 which guides the medium S in the case body 45 by coming into contact with an end portion of the medium S to be accommodated. The edge guide 46 is provided to extend upward from the bottom wall 43 of the case body 45. The edge guide 46 in the embodiment includes a pair of side edge guides 47 which is capable of coming into contact with both ends of the medium S to be accommodated in the width direction, and a rear edge guide 48 which is capable of coming into contact with a rear end of the medium S, which is a front side in the depth direction. The side edge guides 47 are provided to face each other in the width direction, and are disposed along a part of a side wall 49 which is a part of a peripheral wall of the case body 45 and positioned on both ends in the width direction. In addition, the side edge guides 47 are provided to be capable of engaging with each other so as to move in the width direction, and capable of changing a distance between the side edge guides 47 facing each other. That is, the side edge guides 47 can be moved along the width direction depending on a length of the medium S to be accommodated in the width direction.

The rear edge guide 48 is positioned at the center in the width direction in the case body 45, and is disposed at a position which is a front side in the depth direction so as to move along a part of a rear surface of the operating plate 44. The rear edge guide 48 is provided to be movable in the depth direction and is capable of changing a distance with the side wall 50, which is a part of a peripheral wall of the case body 45 and is positioned on a depth side in the depth direction. That is, the rear edge guide 48 is capable of moving the medium S in the depth direction depending on the length of the medium S to be accommodated in the depth direction. Also, the medium S being accommodated in the medium accommodating member 23 is surrounded by the side wall 50 which is a depth side in the depth direction in the case body 45, the pair of side edge guides 47, and the rear edge guide 48, and thus each end portion thereof is guided in the case body 45.

In the case body 45, the hopper 41 for pushing up the medium S being accommodated in the case body 45 is provided. In order for the hopper 41 illustrated in FIG. 3 to be positioned at the standby position WP, the hopper 41 is disposed along the bottom wall 43 of the case body 45 which is the bottom wall 43 of the medium accommodating member 23. Here, the standby position WP is a position in which interference other members with the medium S to be accommodated is avoid at the time of attaching and detaching the medium accommodating member 23 to and from the apparatus main body 12. Also, the hopper 41 which supports the medium S from the bottom includes a plurality of notches 51 for securing a moving region of the edge guide 46. That is, a part of the bottom wall 43 of the case body 45 is exposed through the notch 51.

The hopper 41 includes a bent piece 53 which is bent from a supporting surface 52 for supporting the medium S toward an upper side on the front side in the depth direction and both ends in the width direction. The hopper 41 is disposed so that the bent piece 53 is along the side wall 49 in the width direction of the case body 45. Also, in the hopper 41, a part near the front side of the bent piece 53 in the depth direction and the side wall 49 of the case body 45 are attached to each other through a pin 54. That is, the hopper 41 moves between the feeding position SP and the standby position WP by rotating around the pin 54 as a fulcrum.

In addition, the hopper 41 includes an edge portion 56 penetrating a guide hole 55 opened on the side wall 49 of the case body 45 in the width direction on the depth side in the depth direction and both ends in the width direction. The guide hole 55 is opened to a part near the depth side in the depth direction in the side wall 49, and is provided to extend vertically. That is, in the hopper 41, at the time of moving between the feeding position SP and the standby position WP, the edge portion 56 vertically moves along the guide hole 55. In short, the guide hole 55 guides movement of the hopper 41 through the edge portion 56. In a case in which the hopper 41 is positioned at the feeding position SP, the edge portion 56 is positioned on an upper side of the guide hole 55, and in a case in which the hopper 41 is positioned at the standby position WP, the edge portion 56 is positioned on a lower side of the guide hole 55.

Figure 4:
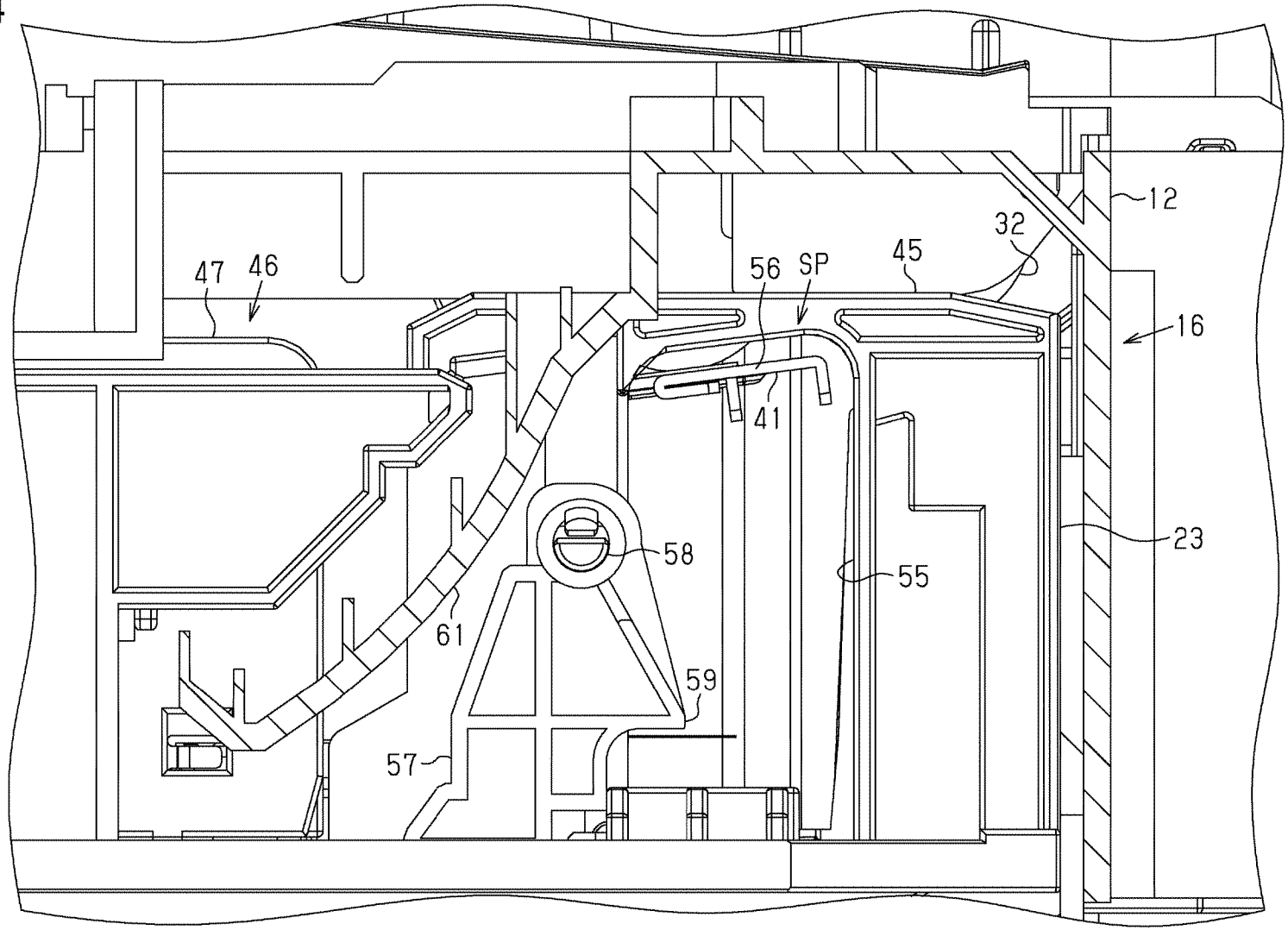
FIG. 4 is a sectional view illustrating a part in which a guide surface is provided in the printing apparatus.

As illustrated in FIGS. 3 and 4, the medium accommodating member 23 includes a locking portion 57 which is capable of locking the hopper 41 positioned at the standby position WP. The locking portion 57 is disposed to be adjacent to the guide hole 55 opened to the side wall 49 of the case body 45, and is attached to the side wall 49 through the pin 58. The locking portion 57 is positioned on a front side of the guide hole 55 in the depth direction, and is disposed to the outside of the side wall 49 in the width direction. The locking portion 57 includes a claw 59 which is capable of being engaged with the edge portion 56 of the hopper 41 positioned at the standby position WP. When seen from the width direction, the claw 59 extends so that a distal end thereof overlaps the front side of the guide hole 55 in the depth direction.

In addition, the locking portion 57 is configured to be rotatable around the pin 58. The locking portion 57 is movable between a locking position for locking the hopper 41 positioned at the standby position WP and an unlocking position for unlocking the locking hopper by rotating around the pin 58. Also, the locking portion 57 illustrated in FIGS. 3 and 4 is positioned at the locking position. By a torsion spring which is not illustrated, the locking portion 57 is always biased so as to be positioned at the locking position in which the claw 59 overlaps the guide hole 55. That is, by the torsion spring which is not illustrated, the locking portion 57 in the embodiment is biased in a counterclockwise direction based on the pin 58 in FIG. 4 so that the claw 59 faces the depth side in the depth direction.

Here, a case is considered in which the hopper 41 is displaced at the standby position WP from the feeding position SP. When the hopper 41 moves toward a lower side of the feeding position SP, the edge portion 56 which is a part of the hopper 41 moves to a lower side along the guide hole 55, and comes into contact with the claw 59 at the locking portion 57 overlapping the guide hole 55. Also, when the hopper 41 further moves to the lower side, the edge portion 56 moves to the lower side along the guide hole 55 so as to press down the claw 59 of the locking portion 57. At this time, the locking portion 57 is rotated in a clockwise direction around the pin 58 in FIG. 4 so that the claw 59 moves toward the front side in the depth direction by coming into contact with the edge portion 56. Also, when the edge portion 56 moves toward the lower side over the claw 59, and reaches the standby position WP, the locking portion 57 returns to the locking position due to a biasing force of the torsion spring not illustrated, and locks the hopper 41 positioned at the standby position WP such that the hopper does not move to the upper side. Also, the locking of the locking portion 57 is released by rotating the locking portion 57 when the claw 59 moves toward the front side in the depth direction against the biasing force of the torsion spring. That is, the locking portion 57 is rotated around the pin 58, and a position in which the claw 59 moves toward the front side in the depth direction is set as the unlocking position.

As illustrated in FIG. 4, in a state in which the medium accommodating member 23 is mounted in the medium accommodating portion 16 which is a part of the apparatus main body 12, a cam 61 with which the edge portion 56, which is a part of the hopper 41, comes into contact when the medium accommodating member 23 is attached to or detached from the apparatus main body 12 is provided on a part facing the side wall 49 in the width direction of the case body 45 constituting the medium accommodating member 23. The cam 61 is disposed at a position which is a front side of the edge portion 56 in the depth direction in a state in which the medium accommodating member 23 is mounted in the apparatus main body 12. In addition, the cam 61 is bent so as to extend to a lower side from the depth side toward the front side in the pulling-out direction of the medium accommodating member 23. Also, at the time of pulling out the medium accommodating member 23 from the apparatus main body 12, the cam 61 causes a position of the hopper 41 to be displaced against the biasing force of the biasing member 42 by coming into contact with the edge portion 56 of the hopper 41. That is, at the time of pulling out the medium accommodating member 23 from the apparatus main body 12, the hopper 41 is displaced from the feeding position SP to the standby position WP by being guided the edge portion 56 along the cam 61.

Figure 5:
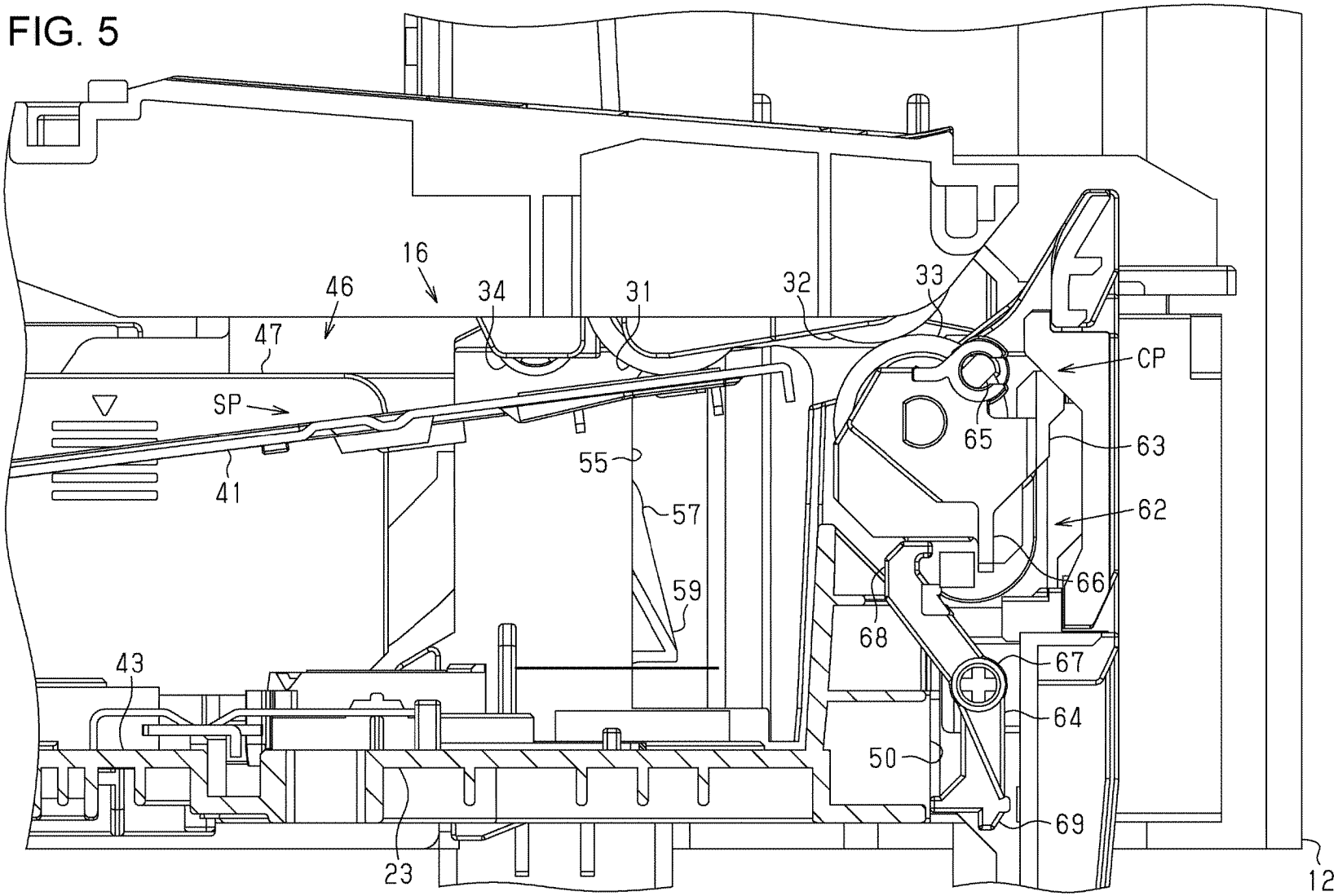
FIG. 5 is a sectional view when a retard roller is positioned at a contacting position.

As illustrated in FIG. 5, the apparatus main body 12 includes a displacing mechanism 62 for displacing a position of the retard roller 33 with respect to the separating roller 32 in accordance with attaching and detaching of the medium accommodating member 23 to and from the apparatus main body 12. The displacing mechanism 62 is disposed on the depth side of the medium accommodating portion 16 in which the medium accommodating member 23 is attached to and detached from in the depth direction. The displacing mechanism 62 in the embodiment includes a retard holder 63 which rotatably supports the retard roller 33, and a lever 64 which is capable of coming into contact with the retard holder 63. The retard holder 63 is attached to the apparatus main body 12 through a shaft 65, and is rotatable around the shaft 65. In addition, the retard holder 63 includes a protruding piece 66 in which a distal end of the lever 64 is capable of coming into contact with on a lower portion thereof. Also, the retard holder 63 causes the retard roller 33 to be displaced by being rotated around the shaft 65, between two positions of a contacting position CP at which the retard roller 33 is capable of coming into contact with the separating roller 32 and a non contacting position LP (refer to FIG. 6) at which the retard roller 33 is separated from the separating roller 32. The retard roller 33 in FIG. 5 is positioned at the contacting position CP. Also, the retard holder 63 in the embodiment is biased so that the retard roller 33 is positioned at the contacting position CP by a spring which is not illustrated.

The lever 64 is disposed under the retard holder 63, and is attached to the apparatus main body 12 through the shaft 67. The lever 64 is configured to be rotatable around the shaft 67. In addition, the lever 64 includes a pressing piece 68 upwardly extending from a position to which the shaft 67 is attached and a contacting piece 69 downwardly extending therefrom. Also, the lever 64 is always biased by a spring which is not illustrated, such that the pressing piece 68 comes into contact with the protruding piece 66 of the retard holder 63. That is, the lever 64 in the embodiment is biased by the spring which is not illustrated, such that the pressing piece 68 based on the shaft 67 faces the depth side in the depth direction and the contacting piece 69 faces the front side. Also, a biasing force of the spring for biasing the lever 64 is set to be greater than a biasing force of the spring for biasing the retard holder 63. Therefore, the lever 64 causes the retard holder 63 to be displaced from the contacting position CP to the non contacting position LP when the pressing piece 68 facing the depth side presses the protruding piece 66 of the retard holder 63 facing the depth side.

Here, in a state in which the medium accommodating member 23 is mounted in the medium accommodating portion 16, the contacting piece 69 of the lever 64 comes into contact with the side wall 50 on the depth side of the medium accommodating member 23. When the side wall 50 of the medium accommodating member 23 comes into contact with the contacting piece 69 of the lever 64, a rotating operation of the lever 64 around the shaft 67 is regulated. In addition, in a state in which the medium accommodating member 23 is mounted in the medium accommodating portion 16, the contacting piece 69 of the lever 64 is pressed in the depth side by the side wall 50 of the medium accommodating member 23. When the contacting piece 69 of the lever 64 is pressed to the depth side in the depth direction, the pressing piece 68 of the lever 64 is positioned on the front side in the depth direction so as to be separated from the protruding piece 66 of the retard holder 63. That is, in a case in which the medium accommodating member 23 is mounted in the medium accommodating portion 16, the pressing piece 68 of the lever 64 does not come into contact with the protruding piece 66 of the retard holder 63, and thus the retard roller 33 is positioned at the contacting position CP.

Figure 6:
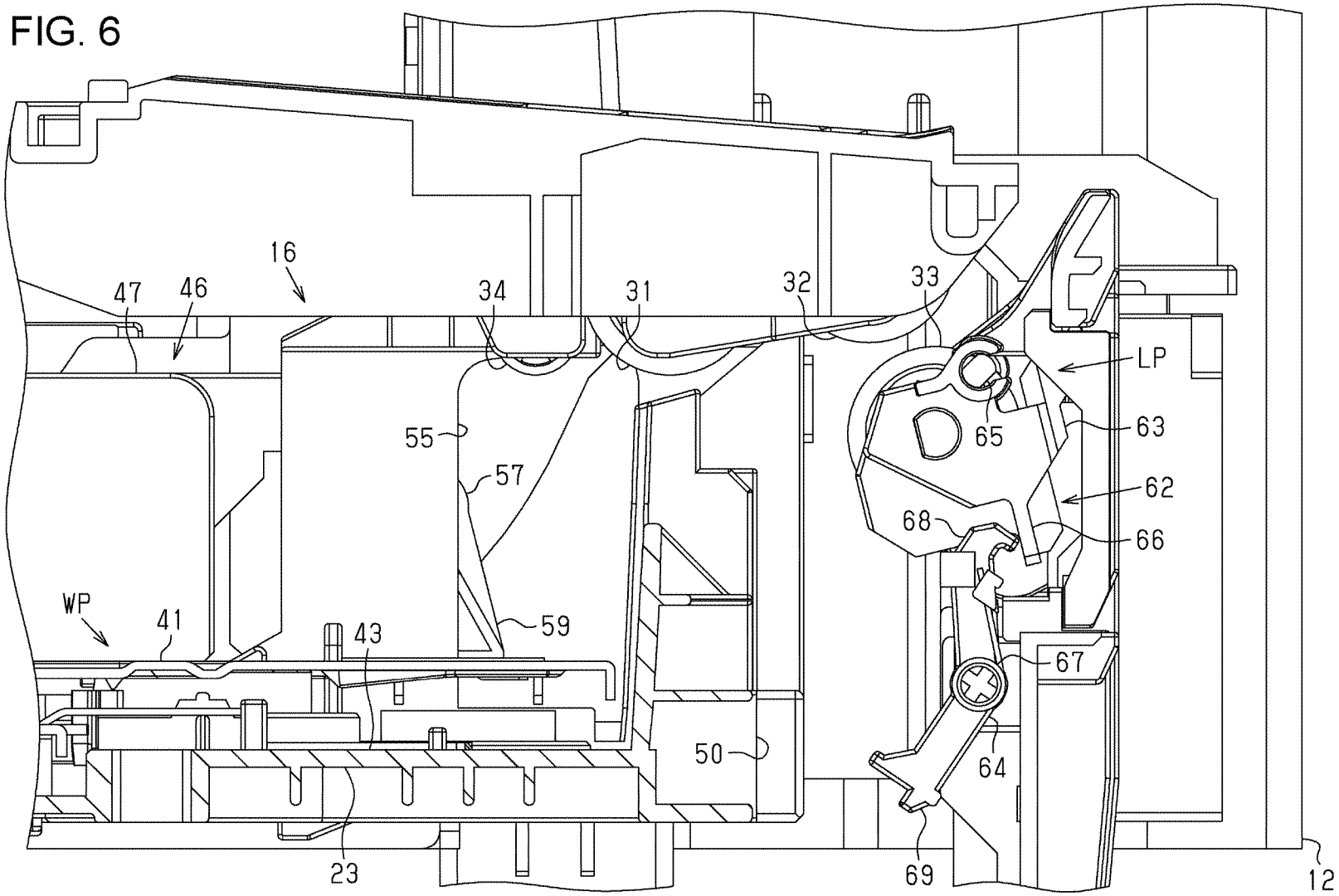
FIG. 6 is a sectional view when the retard roller is positioned at a non contacting position.

As illustrated in FIG. 6, in a state in which the medium accommodating member 23 is pulled out from the medium accommodating portion 16, the side wall 50 on the depth side of the medium accommodating member 23 is separated from the contacting piece 69 of the lever 64. When the side wall 50 of the medium accommodating member 23 is separated from the contacting piece 69 of the lever 64, the lever 64 is rotated so that the pressing piece 68 faces the depth side and the contacting piece 69 faces the front side. That is, in a case in which the medium accommodating member 23 is pulled out from the medium accommodating portion 16, the pressing piece 68 of the lever 64 comes into contact with the contacting piece 69 of the retard roller 33, and the retard roller 33 is positioned at the non contacting position LP. To summarize, at the time of mounting the medium accommodating member 23 in the apparatus main body 12, the displacing mechanism 62 causes the retard roller 33 to be displaced to the contacting position CP where the retard roller is capable of coming into contact with the separating roller 32, and at the time of pulling out the medium accommodating member 23 from the apparatus main body 12, causes the retard roller 33 to be displaced to the non contacting position LP where the retard roller is separated from the separating roller 32.

Figure 7:
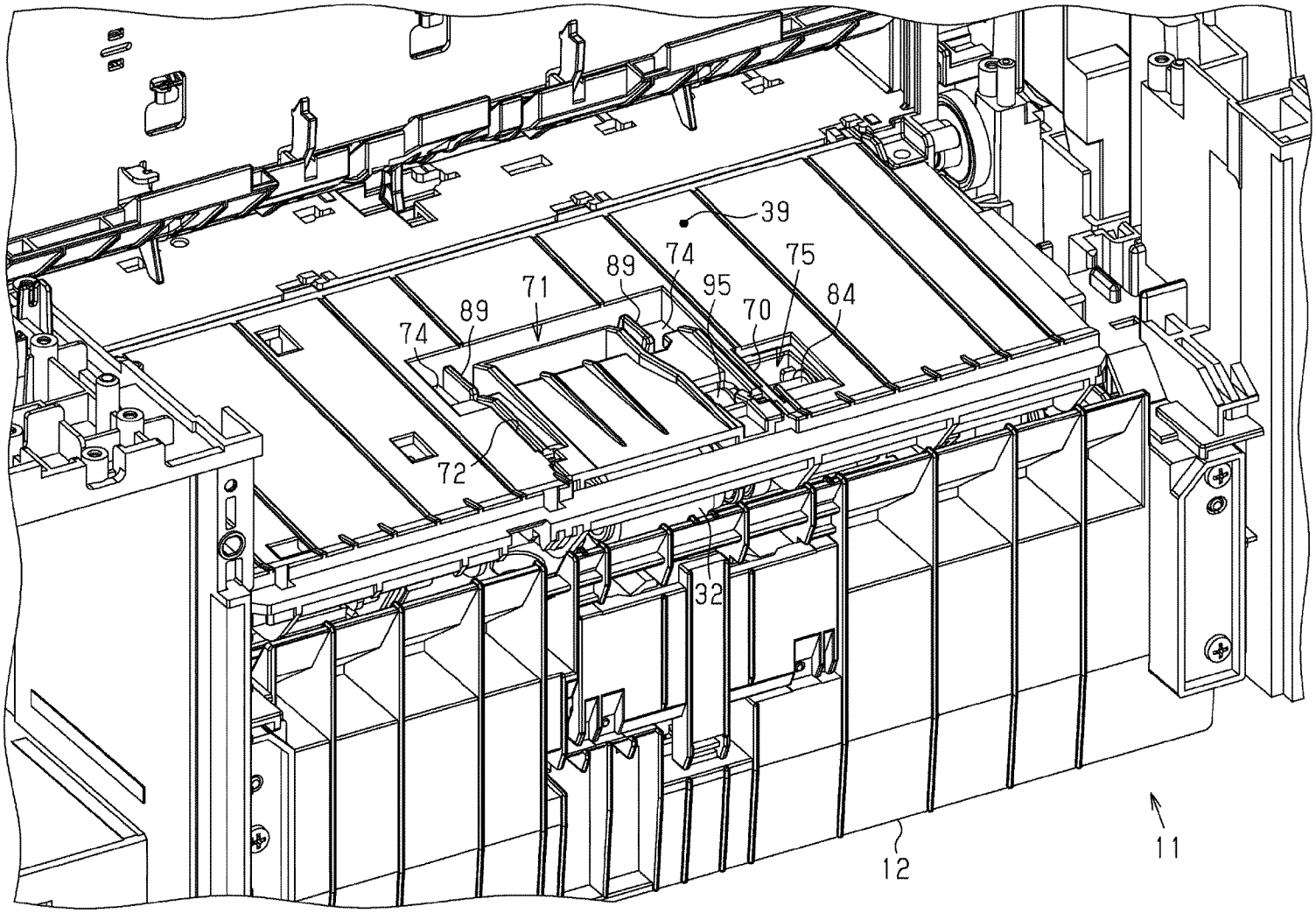
FIG. 7 is a perspective view of the printing apparatus in a state in which a transporting unit is mounted.
Figure 8:
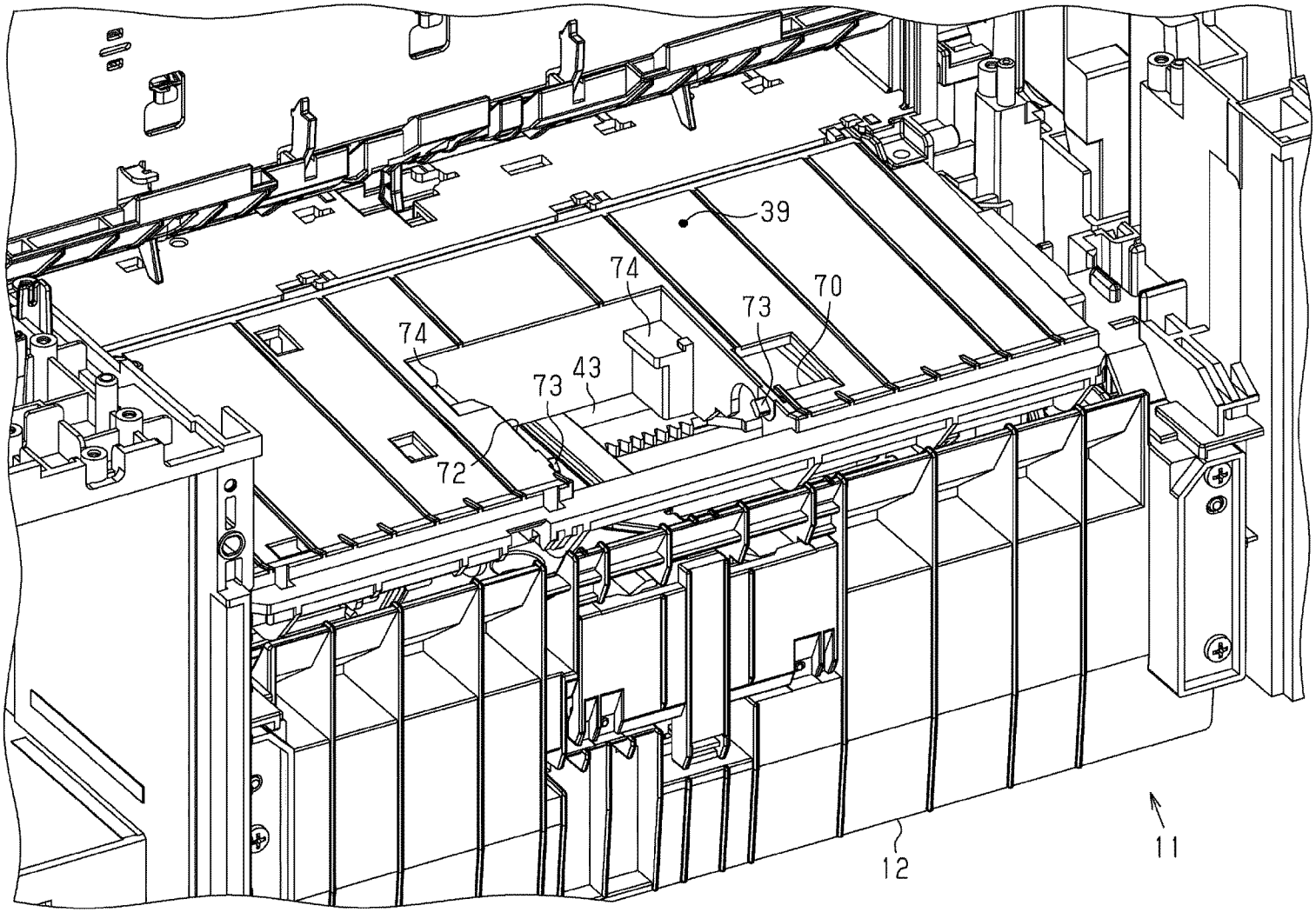
FIG. 8 is a perspective view of the printing apparatus in a state in which the transporting unit is removed.

As illustrated in FIGS. 7 and 8, the printing apparatus 11 in the embodiment is provided with a transporting unit 71 constituting a part of the double-sided printing passage 39. Also, FIGS. 7 and 8 are perspective views of the double-sided printing passage 39 being provided inside the apparatus main body 12 when seen from a rear side of the printing apparatus 11. The transporting unit 71 can be attached to or detached from a mounting hole 72 which is opened to a center part in the width direction in the double-sided printing passage 39. In addition, inside the mounting hole 72, at both ends positions in the width direction on the depth side in the depth direction, the boss 73 for rotatably supporting the transporting unit 71 is provided. In addition, inside the mounting hole 72, at both ends positions in the width direction on the front side in the depth direction, a fixing member 74 for fixing the transporting unit 71 to the mounting hole 72 is provided. Also, at a position adjacent to the transporting unit 71 mounted in the mounting hole 72, the transmitting mechanism 75 for transmitting a driving force to the transporting unit 71 is disposed. In the double-sided printing passage 39, at a position adjacent to the mounting hole 72 in the width direction, an exposing hole 70 in which a part of the transmitting mechanism 75 is exposed is opened.

Figure 9:
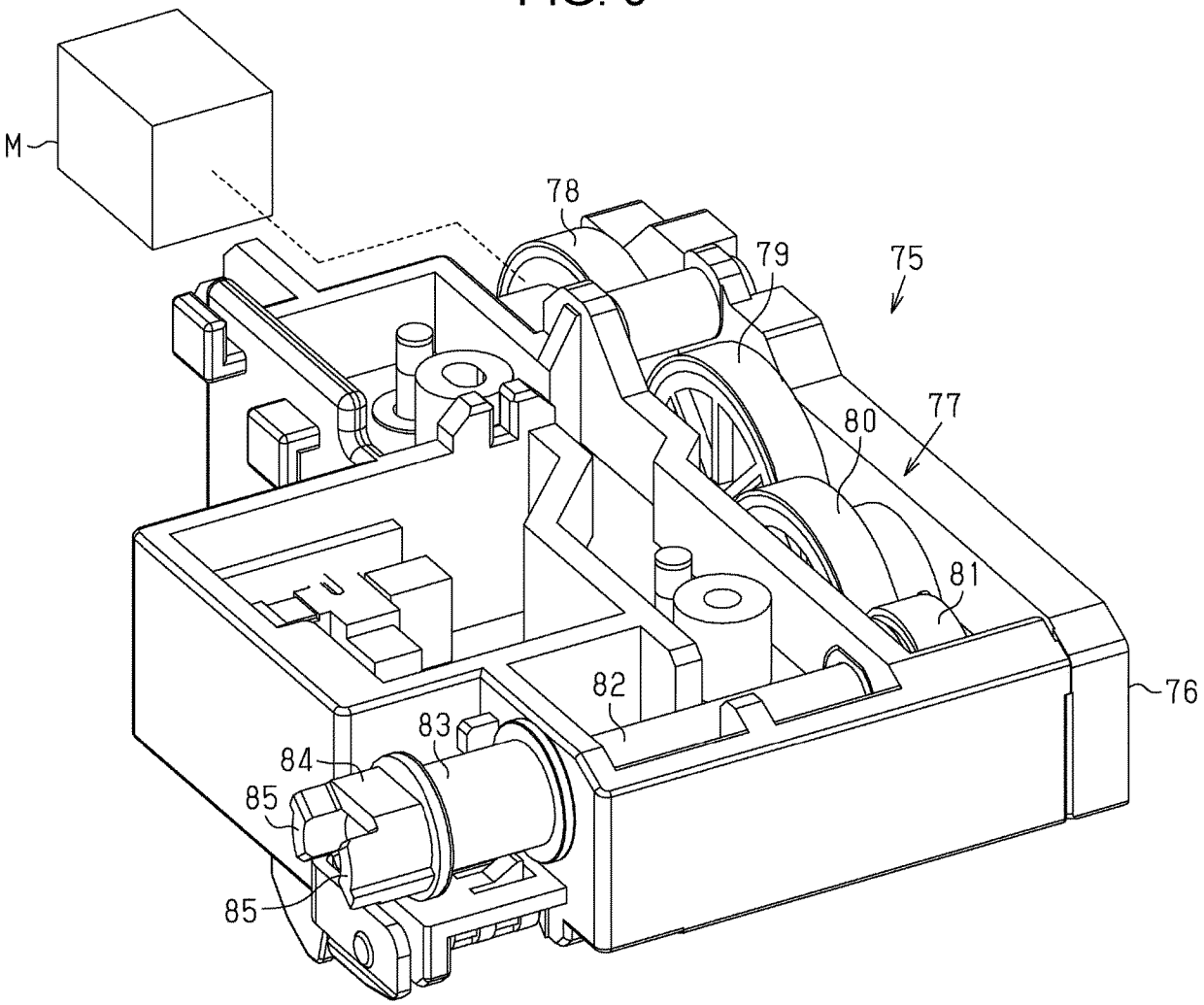
FIG. 9 is a perspective view of a transmitting mechanism.
Figure 10:
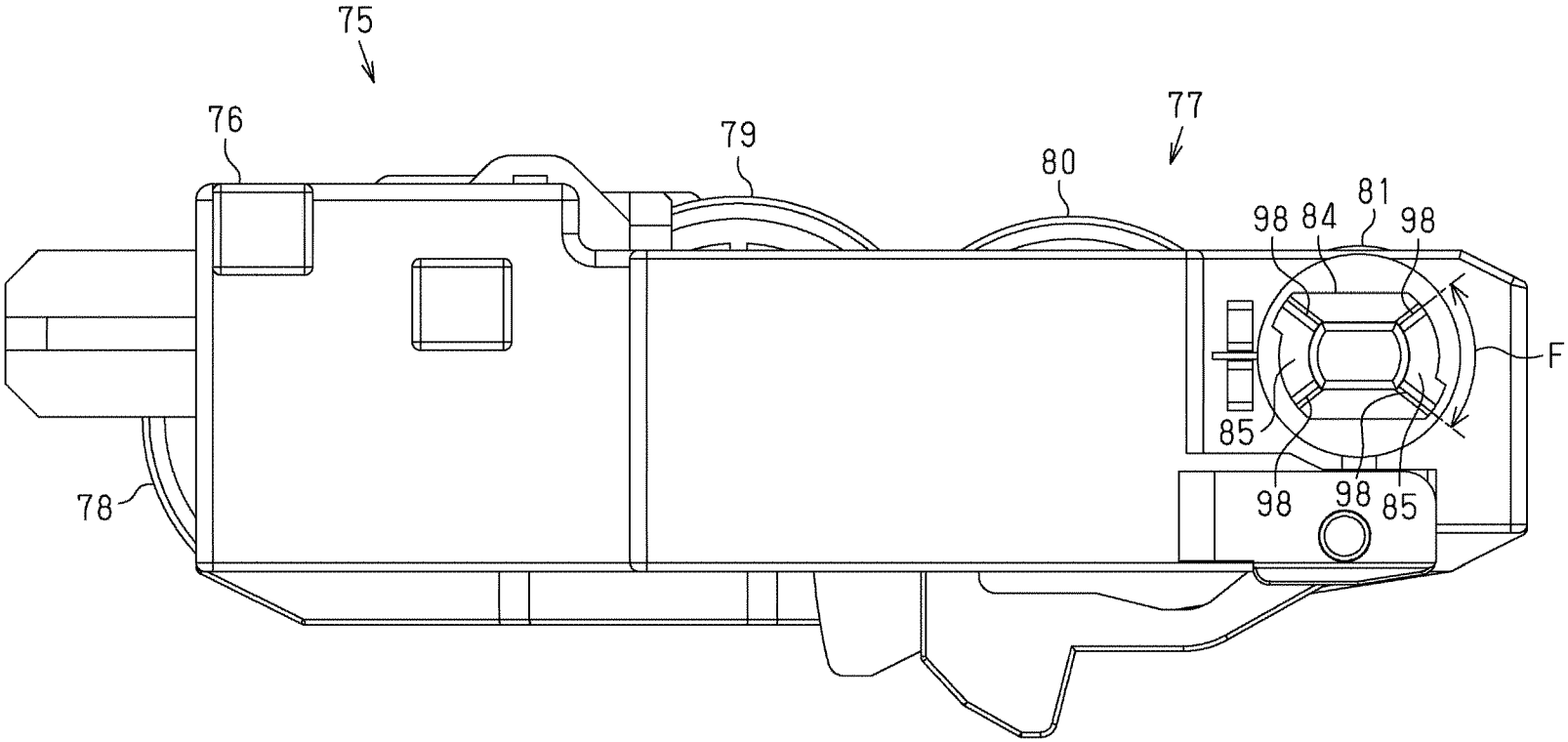
FIG. 10 is a side view of the transmitting mechanism.

As illustrated in FIGS. 9 and 10, the transmitting mechanism 75 includes a plurality of gears and a frame 76 for rotatably supporting the individual gear. The plurality of gears constitutes a gear train 77 by being disposed so as to be respectively engaged in the frame 76. The transmitting mechanism 75 in the embodiment includes total four gears of a first spur gear 78, a second spur gear 79, a third spur gear 80, and a fourth spur gear 81. The first spur gear 78, the second spur gear 79, the third spur gear 80, and the fourth spur gear 81 can be rotatable in synchronization with each other. The gear train 77 is configured so that the second spur gear 79 is engaged with the first spur gear 78 and the third spur gear 80, and the third spur gear 80 is engaged with the second spur gear 79 and the fourth spur gear 81. That is, in the gear train 77, the first spur gear 78 and the fourth spur gear 81 are positioned on an end in the gear train 77. Also, in the embodiment, the first spur gear 78 and the third spur gear 80 are provided as a two-stage gear formed by overlapping a gear having a small diameter and a gear having a large diameter with the same axis.

In the fourth spur gear 81, a transmitting shaft 82 for transmitting a driving force to the transporting unit 71 is attached. The transmitting shaft 82 is fixed to the fourth spur gear 81, and is rotatable as a rotating shaft of the fourth spur gear 81 with the fourth spur gear 81. Also, in the transmitting mechanism 75 in the embodiment, for example, a driving source M such as a motor is connected to the first spur gear 78. That is, in the transmitting mechanism 75 in the embodiment, the driving force of the driving source M being input to the first spur gear 78 is output from the fourth spur gear 81. In addition, a joint member 84 which is capable of connecting the transmitting shaft 82 to the transporting unit 71 is provided on a distal end of the transmitting shaft 82 extending from the fourth spur gear 81, through the joint 83 which is capable of expanding and contracting in a direction where the transmitting shaft 82 extends. Also, in the embodiment, the direction where the transmitting shaft 82 extends is the same as the width direction of the printing apparatus 11.

The joint member 84 is rotatable with the transmitting shaft 82. In addition, the joint member 84 includes an engagement projection 85 for being engaged with the transporting unit 71 in order to transmit the driving force to the transporting unit 71. The joint member 84 in the embodiment includes two engagement projections 85. The engagement projection 85 is symmetrically provided based on the transmitting shaft 82 which is a rotating shaft of the joint member 84, and protrudes in the same direction as a direction where the transmitting shaft 82 extends. In addition, when seen from the direction where the transmitting shaft 82 extends, the engagement projection 85 is formed in a substantially arch shape which is a curved line shape protruding toward in a radial outward direction based on the transmitting shaft 82.

Figure 11:
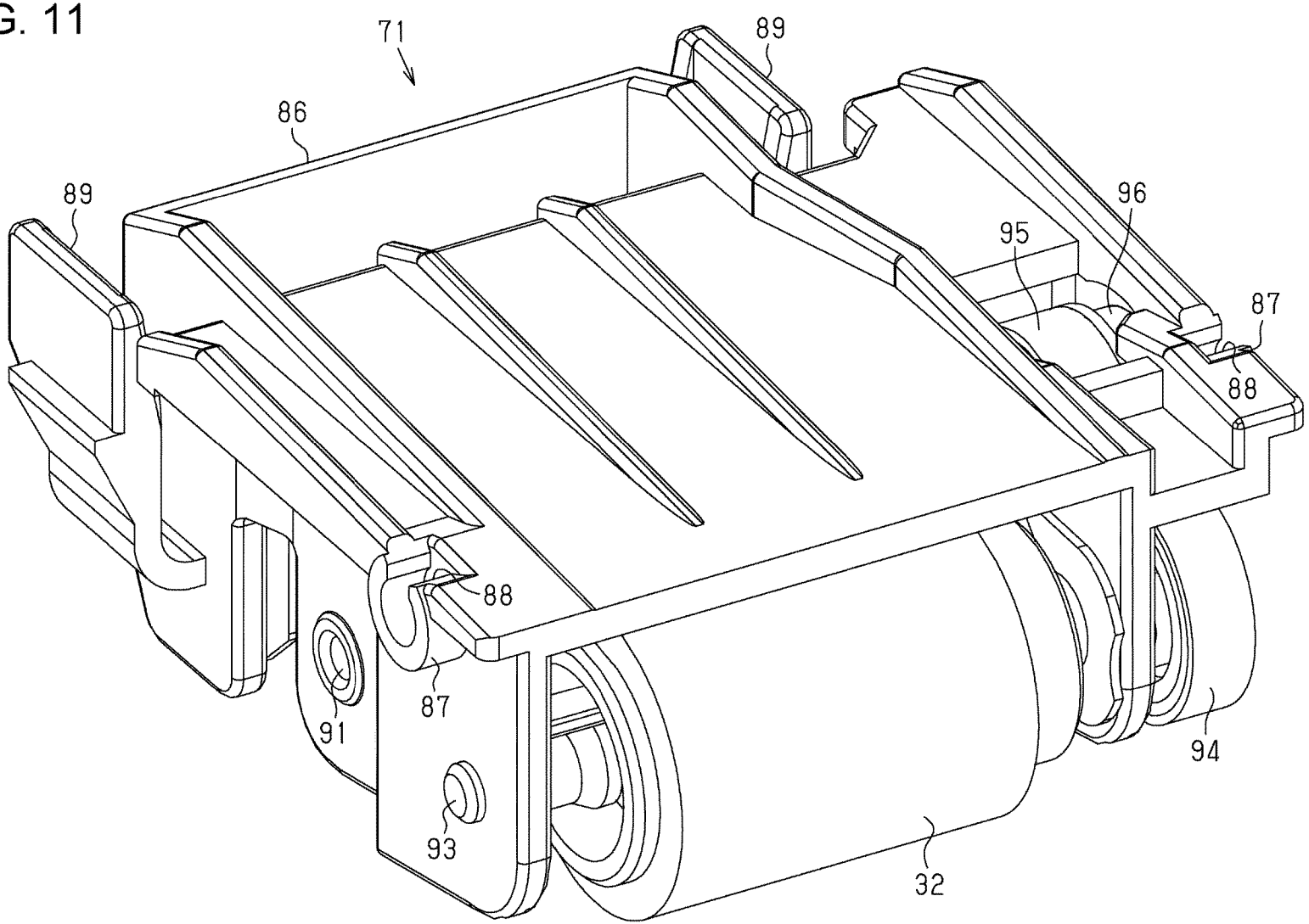
FIG. 11 is a perspective view of the transporting unit.

As illustrated in FIGS. 8 and 11, the transporting unit 71 includes a holder 86. In a state in which the holder 86 is mounted in the mounting hole 72, an upper surface of the holder constitutes a part of the double-sided printing passage 39. In the holder 86, a shaft bearing 87 which can be attached to the boss 73 is provided at a position corresponding to the boss 73 being provided in the mounting hole 72. That is, in the transporting unit 71 in a state of being mounted in the mounting hole 72, the shaft bearing 87 is provided at both ends positions in the width direction on the depth side in the depth direction. Also, the shaft bearing 87 includes a notch 88 through which the boss 73 passes at the time of attaching the boss 73.

In addition, in the holder 86, an engaging claw 89 which is capable of being engaged with the fixing member 74 is provided at a position corresponding to the fixing member 74 being provided the mounting hole 72. That is, in the transporting unit 71 in a state of being mounted in the mounting hole 72, the engaging claw 89 is provided at both ends positions in the width direction on the front side in the depth direction. The engaging claw 89 is configured to be elastically transformable. That is, when the transporting unit 71 is mounted in the mounting hole 72, first, the shaft bearing 87 of the transporting unit 71 is attached to the boss 73 of the mounting hole 72. At this time, the transporting unit 71 is attached to the boss 73 through the notch 88 of the shaft bearing 87. Also, in a state in which the shaft bearing 87 is attached to the boss 73, the transporting unit 71 is rotated around the boss 73, and the engaging claw 89 of the transporting unit 71 is engaged with the fixing member 74 of the mounting hole 72. The transporting unit 71 is engaged with the fixing member 74 when the engaging claw 89 is elastically transformed, and is mounted in the mounting hole 72. Also, when the transporting unit 71 is removed from the mounting hole 72, the engaging claw 89 is grabbed and elastically transformed, and engaging of the engaging claw 89 with the fixing member 74 is released.

Figure 12:
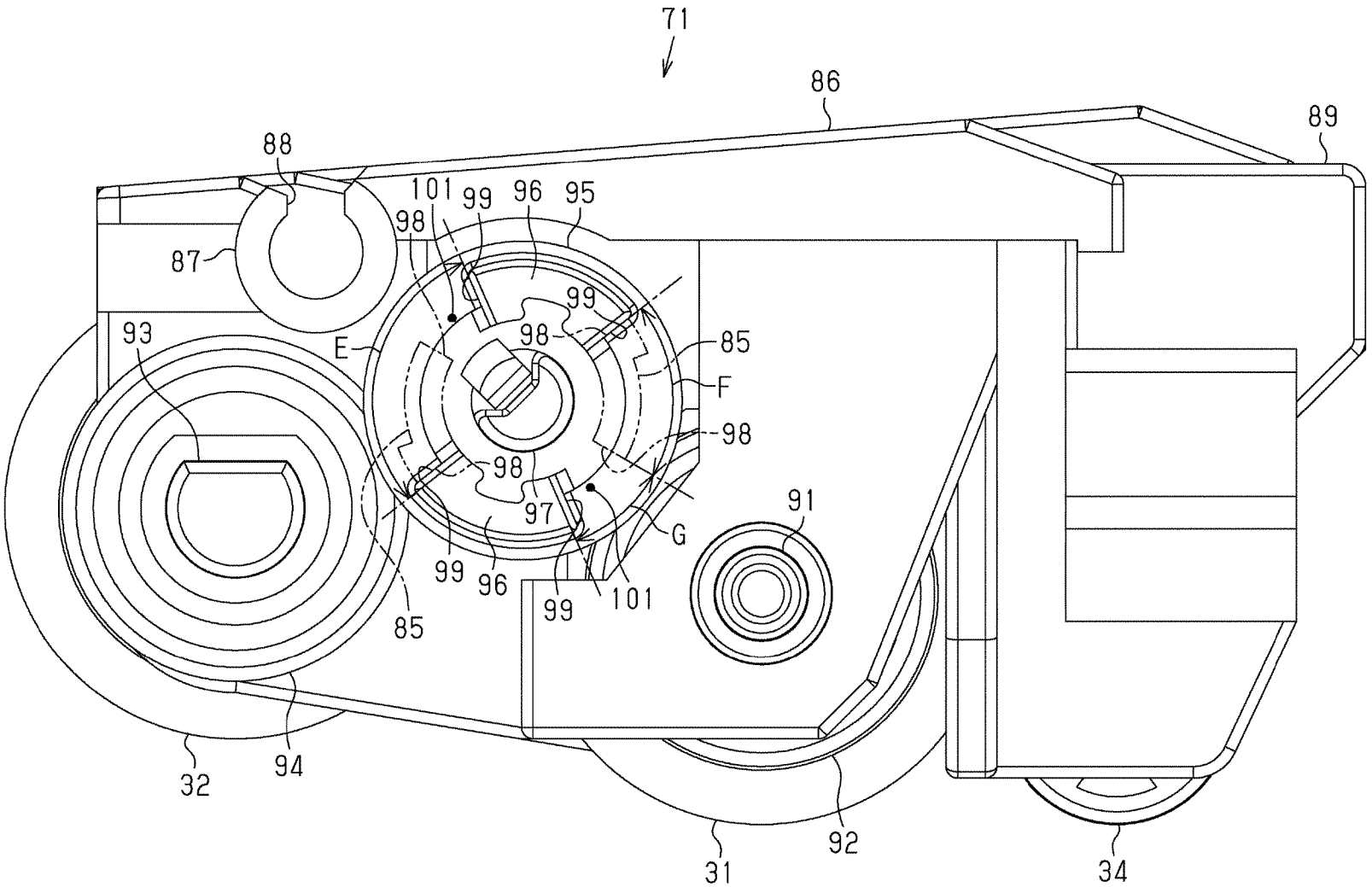
FIG. 12 is a side view of the transporting unit.

As illustrated in FIGS. 11 and 12, the transporting unit 71 includes the pickup roller 31, the separating roller 32, and the pressing roller 34. The pickup roller 31, the separating roller 32, and the pressing roller 34 are rotatably attached to the holder 86. The holder 86 includes a first gear 92 which is disposed on the same shaft as the rotating shaft 91 of the pickup roller 31. The first gear 92 can be rotated with the pickup roller 31. In addition, the holder 86 includes a second gear 94 which is disposed on the same shaft as the rotating shaft 93 of the separating roller 32. The second gear 94 can be rotated with the separating roller 32.

Also, the holder 86 includes a driving gear 95 which is disposed between the first gear 92 and the second gear 94. The driving gear 95 is disposed so as to be engaged with each of the first gear 92 and the second gear 94. That is, the driving gear 95 is configured to be rotatable in synchronization with the first gear 92 and the second gear 94. In the embodiment, in FIG. 12, when the driving gear 95 is rotated in the counterclockwise direction, the first gear 92 and the second gear 94 are rotated in a clockwise direction, and the pickup roller 31 and the separating roller 32 are also rotated in the clockwise direction. Also, in FIG. 12, the clockwise direction where the pickup roller 31 and the separating roller 32 are rotated is the same as a forward rotating direction where the pickup roller 31 and the separating roller 32 are rotated at the time of transporting the medium S.

The first gear 92 and the second gear 94 in the embodiment are connected to the pickup roller 31 and the separating roller 32 through an one-way clutch which is not illustrated included in each of the pickup roller 31 and the separating roller 32. The one-way clutch connects the pickup roller 31 and the separating roller 32 to each other so that both are rotatable in the clockwise direction in FIG. 12 with respect to the first gear 92 and the second gear 94 which are stopped. That is, the one-way clutch connects the pickup roller 31 and the separating roller 32 so that the both cannot be rotatable in the counterclockwise direction in FIG. 12 with respect to the first gear 92 and the second gear 94 which are stopped. Also, the driving source M in the embodiment generates the driving force for rotating the pickup roller 31 and the separating roller 32 in the forward rotating direction.

The driving gear 95 includes an engagement projection 96 (second engaging portion) which is capable of being engaged with the engagement projection 85 (first engaging portion) included in the joint member 84 of the transmitting mechanism 75. The driving gear 95 in the embodiment includes two engagement projections 96. The engagement projection 96 is symmetrically provided based on the rotating shaft 97 of the driving gear 95, and protrudes in the same direction as the direction where the rotating shaft 97 extends. Also, the direction where the rotating shaft 97 of the driving gear 95 extends in the width direction of the printing apparatus 11. In addition, when seen in a direction where the rotating shaft 97 extends, the engagement projection 96 is formed in a substantially arch shape which is a curved line shape protruding toward in a radial outward direction based on the rotating shaft 97 of the driving gear 95.

Figure 13:
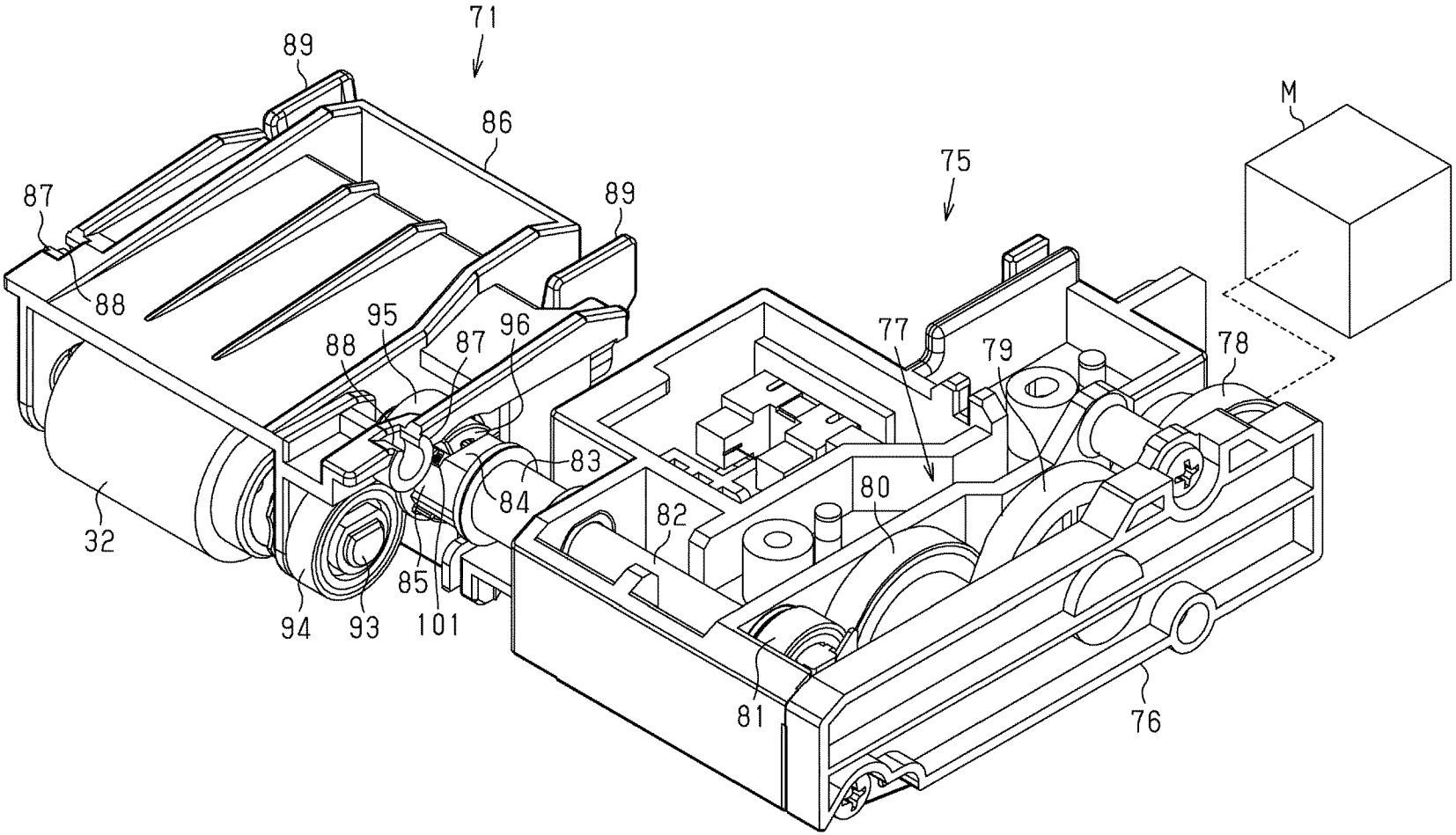
FIG. 13 is a perspective view illustrating a state in which the transporting unit and the transmitting mechanism are connected to each other.

As illustrated in FIGS. 12 and 13, the transporting unit 71 and the transmitting mechanism 75 are connected to each other so as to be capable of transmitting the driving force through the engagement projection 96 of the driving gear 95 and the engagement projection 85 of the joint member 84. Specifically, in a rotating direction when the driving gear 95 and the joint member 84 are rotated, the two engagement projections 85 included in the joint member 84 are respectively connected by being inserted so as to be positioned between the two engagement projections 96 included in the driving gear 95. That is, as illustrated in FIG. 13, the engagement projection 96 and the engagement projection 85 are disposed so as to be engaged with each other. In a state in which the engagement projection 96 and the engagement projection 85 are disposed so as to be engaged with each other, when the joint member 84 is rotated with the transmitting shaft 82 due to the driving force of the driving source M, the engagement projection 85 comes into contact with the engagement projection 96. Also, the engagement projection 96 and the engagement projection 85 are engaged so as to be integrally rotated by coming into contact with each other. At this time, in the engagement projection 85 in a substantially arch shape, one surface (an end surface on a front side in the rotating direction which is a counterclockwise direction side in FIG. 12) of two end surfaces 98, which are an end portion in the rotating direction, comes into contact with one surface (an end surface of a rear side in the rotating direction which is a clockwise direction side in FIG. 12) of two end surfaces 99 of the engagement projection 96 in a substantially arch shape. Also, when the engagement projection 85 of the joint member 84 which is rotated causes the driving gear 95 to be rotated through the engagement projection 96, the driving force is transmitted to the transporting unit 71 from the driving source M through the transmitting mechanism 75. That is, the transmitting mechanism 75 transmits the driving force of the driving source M to the pickup roller 31. Also, the transmitting mechanism 75 in the embodiment transmits the driving force of the driving source M to not only the pickup roller 31 but also the separating roller 32.

Here, in a rotating direction when the driving gear 95 and the joint member 84 are rotated, a length of a rotating direction in the engagement projection 85 of one joint member 84 being disposed between the engagement projections 96 is shorter than a distance between two engagement projections 96 included in the driving gear 95. That is, in the rotating direction, if a distance between the end surfaces 99 with the two engagement projections 96 facing each other at an interval is set as a length E, and a distance between the end surfaces 98 of both ends in one engagement projection 85 is set as a length F, a relationship between both distances is E>F. Therefore, in a state in which one end surface 99 in the engagement projection 96 and one end surface 98 in the engagement projection 85 are in contact with each other, between another end surface 99 in the engagement projection 96 and another end surface 98 in the engagement projection 85, allowance 101 having a length G (=E-F) is generated. The allowance 101 is provided in a connecting part in which the driving gear 95 and the joint member 84 are connected by the engagement projection 96 and the engagement projection 85. That is, the driving force of the driving source M is transmitted through the allowance 101.

Also, as illustrated in FIG. 7, the transmitting mechanism 75 being provided in the apparatus main body 12 is disposed so that the joint 83 is exposed from the exposing hole 70 provided in the double-sided printing passage 39 of the apparatus main body 12. Also, when the transporting unit 71 is attached to or detached from the mounting hole 72, a finger is inserted into the exposing hole 70, the joint 83 capable of expanding and contracting in the width direction is contracted toward the fourth spur gear 81 side, and thus connection of the transporting unit 71 with the transmitting mechanism 75 is released. When the connection with the transmitting mechanism 75 is released, the transporting unit 71 can be taken out from the mounting hole 72. In addition, even when the transporting unit 71 is mounted, the transporting unit is mounted in a state in which the joint 83 is contracted.

Figure 14:
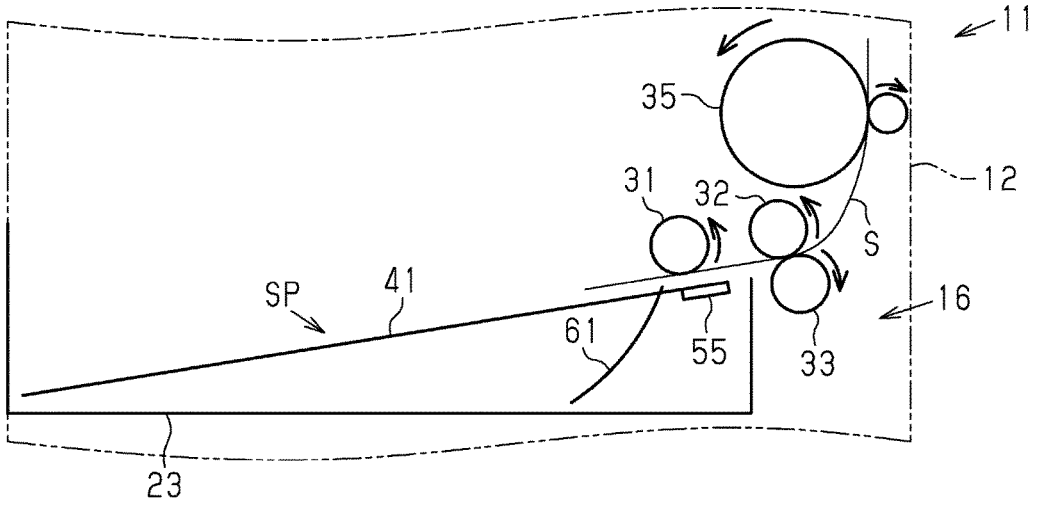
FIG. 14 is a schematic side view when a medium is transported from the medium accommodating member.

As illustrated in FIG. 14, when the printing apparatus 11 performs printing on the medium S, the pickup roller 31 takes out the medium S accommodated in the medium accommodating member 23, and the separating roller 32 and the retard roller 33 pinch and transport the medium S. Also, when a distal end of the transported medium S comes into contact with the feed roller 35, and the medium S is delivered to the feed roller 35, the pickup roller 31 and the separating roller 32 are stopped to be rotated due to the driving force of the driving source M. At this time, since a rear end of the medium S delivered to the feed roller 35 is positioned inside the medium accommodating member 23, the medium is in contact with the pickup roller 31 and the separating roller 32 which are stopped to drive. That is, the pickup roller 31 and the separating roller 32 which are stopped to drive are rotated in the forward rotating direction due to a fraction with the transported medium S as the medium S is transported by rotation of the feed roller 35.

Here, when the pickup roller 31 and the separating roller 32 which are stopped to drive are rotated in the forward rotating direction, the first gear 92 and the second gear 94 are also rotated in the same direction. Also, when the first gear 92 and the second gear 94 are rotated, the driving gear 95 is rotated by being engaged thereto. At this time, since the driving of the driving source M is stopped, the joint member 84 engaged with the driving gear 95 is stopped. That is, while the driving gear 95 is rotated, the joint member 84 is not rotated. Therefore, the driving gear 95 is rotated with respect to the joint member 84 so that the engagement projection 96 is close to the stopped engagement projection 85 from a rear side in the rotating direction.

Figure 15:
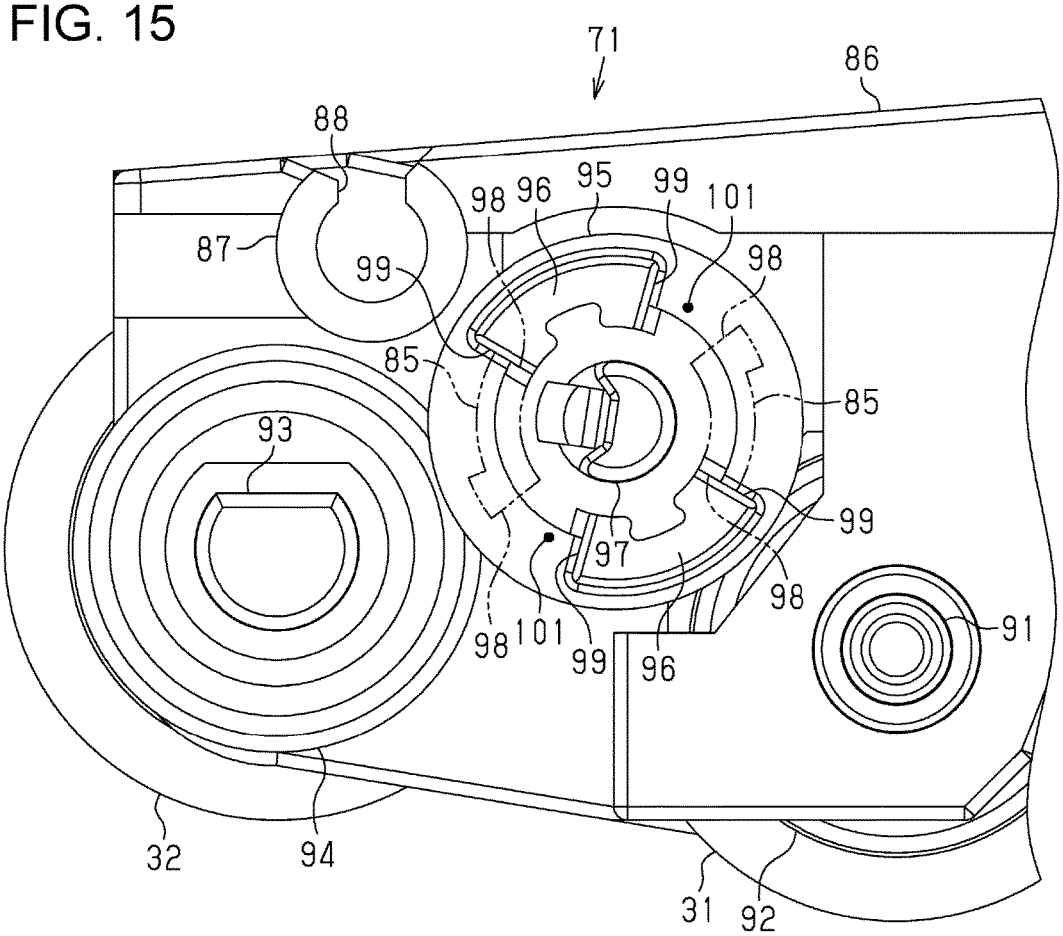
FIG. 15 is a side view of the transporting unit illustrating an allowing portion for reversely rotating a pickup roller.

As illustrated in FIG. 15, when the driving gear 95 is rotated with respect to the stopped joint member 84, another end surface 99, which is different from one end surface 99 of the two end surface in the engagement projection 96 in contact with the engagement projection 85 at the time of being rotated by the driving force of the driving source M, comes in to contact with the engagement projection 85. That is, in FIG. 15, the end surface 99 in the counterclockwise direction side of the engagement projection 96 and the end surface 98 in the clockwise direction side of the engagement projection 85 are in contact with each other. Therefore, in a case in which the surfaces are in contact with each other, between the engagement projection 96 and the engagement projection 85, the allowance 101 is generated between the end surface 99 and the end surface 98 which is different at the time of being rotated due to the driving force of the driving source M. Also, after the engagement projection 96 comes into contact with the engagement projection 85, and rotation of the driving gear 95 is regulated by the joint member 84, the pickup roller 31 and the separating roller 32 are rotated but the first gear 92 and the second gear 94 are not rotated by the one-way clutch included in the pickup roller 31 and the separating roller 32.

The allowance 101, which is generated by rotating the pickup roller 31 in the forward rotating direction in a state in which the joint member 84 is stopped, allows the driving gear 95 to be rotated in the clockwise direction in FIG. 15. That is, the allowance 101 functions as an allowing portion which allows the pickup roller 31 to be rotated in the reverse rotating direction which is a reverse direction of the forward rotating direction.

Next, an action of the printing apparatus 11 configured in such a manner described above will be described.

When the medium S is transported from the medium accommodating member 23, the pickup roller 31 takes out the medium S in a state in which a plurality of medium overlap with each other. For example, in a case in which two sheets of the overlapping medium S are taken out, the separating roller 32 and the retard roller 33 cause the two sheets of the medium S to be separated from each other one by one due to the frictional force, and one sheet of the medium S on an upper side between the two sheets of the medium S which vertically overlap with each other is transported. At this time, after the separating roller 32 and the retard roller 33 transport the one sheet of the medium S on the upper side between the two sheets of the medium S which vertically overlap with each other is transported, the separating roller and the retard roller may be stopped to be rotated in a state of pinching the remaining one sheet of the medium S on the upper side.

Figure 16:
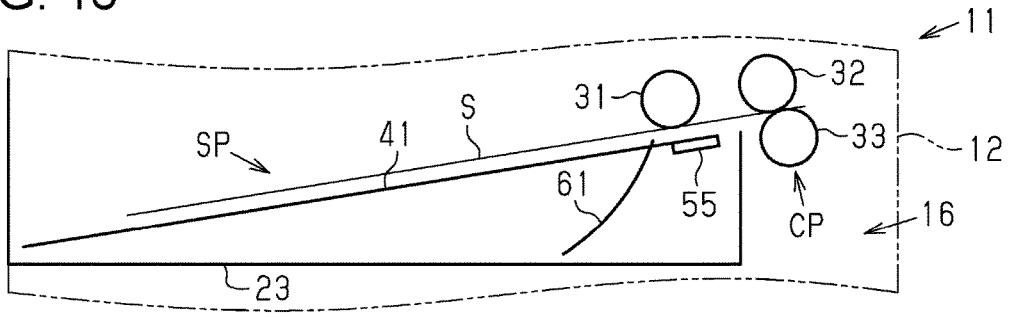
FIG. 16 is a perspective side view before the medium accommodating member is pulled out.

As illustrated in FIG. 16, the medium accommodating member 23 is pulled out from the apparatus main body 12 in a state in which the separating roller 32 and the retard roller 33 pinch the medium S, there is a concern that the medium S pinched between the separating roller 32 and the retard roller 33 may remain inside the apparatus main body 12. In the embodiment, at the time of pulling out the medium accommodating member 23 from the apparatus main body 12, the displacing mechanism 62 causes the retard roller 33 to be displaced to the non contacting position LP from the contacting position CP in accordance with pulling-out of the medium accommodating member. Therefore, at the time of the pulling out the medium accommodating member 23 from the apparatus main body 12, pinching of the medium S between the separating roller 32 and the retard roller 33 is released.

However, at the time of pulling out the medium accommodating member 23 from the apparatus main body 12, even when the pinching of the medium S between the separating roller 32 and the retard roller 33 is released, an end portion on a downstream side in a transporting direction (right side in FIG. 16) of the medium S at the uppermost position inside the medium accommodating member 23 is pressed against the pickup roller 31. Therefore, at the time of pulling out the medium accommodating member 23 from the apparatus main body 12, there is a concern that the medium S may remain inside the apparatus main body 12 due to a friction resistance of the medium S which is pressed against the pickup roller 31 and the pickup roller 31. Regarding this point, in the embodiment, the pickup roller 31 is configured so as to be rotatable in a reverse rotating direction opposite to a rotating direction at the time of transporting the medium S by the pickup roller 31 and the separating roller 32 due to the frictional force with the medium S, which is pulled out along the pulling-out of the medium accommodating member 23 under a circumstance in which the medium S is pressed by the hopper 41 present at the feeding position.

Figure 17:
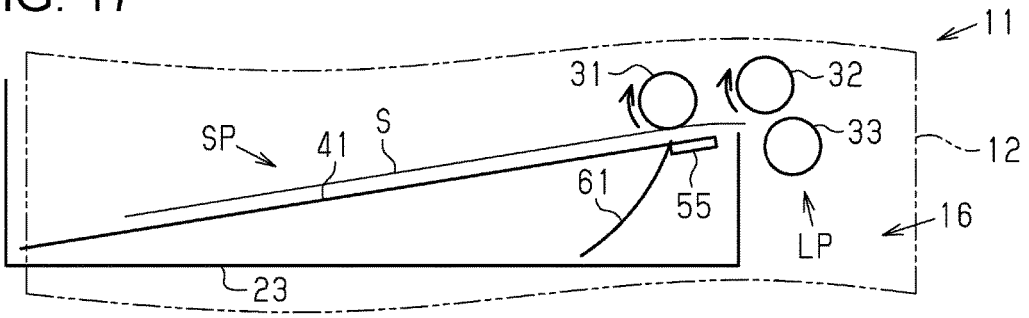
FIG. 17 is a perspective side view when the medium accommodating member starts to be pulled out.

As illustrated in FIG. 17, the medium S, which is released from being pinched between the separating roller 32 and the retard roller 33, is pulled out in a state of being pressed toward the pickup roller 31 by the hopper 41. At this time, the allowance 101 is provided in a connecting part of the driving gear 95 for rotating the pickup roller 31 and the joint member 84 connecting the driving gear 95 (refer to FIG. 15). Therefore, at the time of pulling out the medium accommodating member 23 from the apparatus main body 12, the pickup roller 31 which presses the medium S from the bottom by the hopper 41 of the medium accommodating member 23 is reversely rotated as an amount of the allowance 101 due to the frictional force with the pulled-out medium S in accordance with the pulling-out of the medium accommodating member 23. Therefore, the medium S, which is pressed against the pickup roller 31 in a state in which an end portion on a downstream side in the transporting direction of the medium is mounted in the retard roller 33, is extracted between the separating roller 32 and the retard roller 33, and from the pickup roller 31. Also, in the embodiment, not only the pickup roller 31 but also the separating roller 32 are synchronized and reversely rotated.

Figure 18:
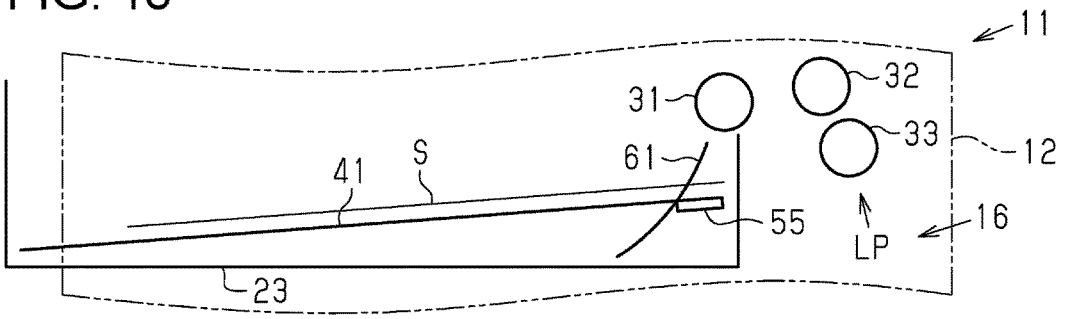
FIG. 18 is a perspective side view when the medium accommodating member is further pulled out from the state illustrated in FIG. 17.
Figure 19:
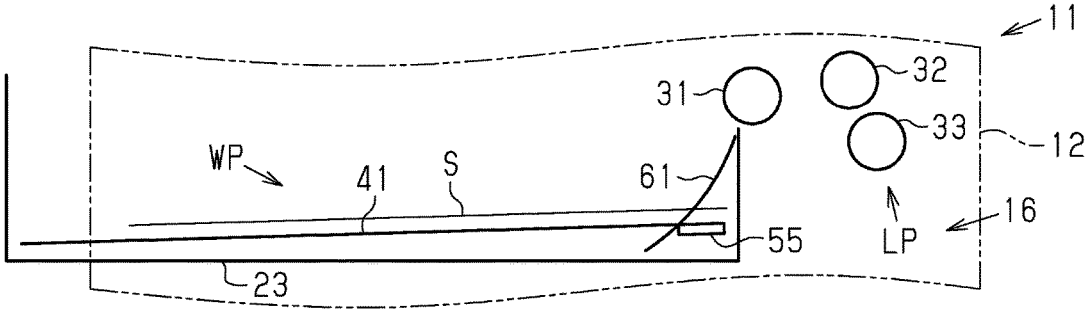
FIG. 19 is a perspective side view when the medium accommodating member is further pulled out from the state illustrated in FIG. 18.

As illustrated in FIGS. 18 and 19, when the medium accommodating member 23 is further pulled out from the apparatus main body 12, the edge portion 56 of the hopper 41 comes into contact with the cam 61. Also, when the edge portion 56 is guided to the cam 61 in accordance with the pulling-out of the medium accommodating member 23, the hopper 41 moves from the feeding position SP toward a lower side of the standby position WP. Also, when the medium accommodating member 23 is further pulled out from the apparatus main body 12, the hopper 41 is locked at the standby position WP, and the medium accommodating member 23 is pulled out from the apparatus main body 12 with the medium S pinched between the separating roller 32 and the retard roller 33.

Next, a case is considered in which the medium accommodating member 23 including a lot of the mediums S accommodated therein is pulled out.

Figure 20:
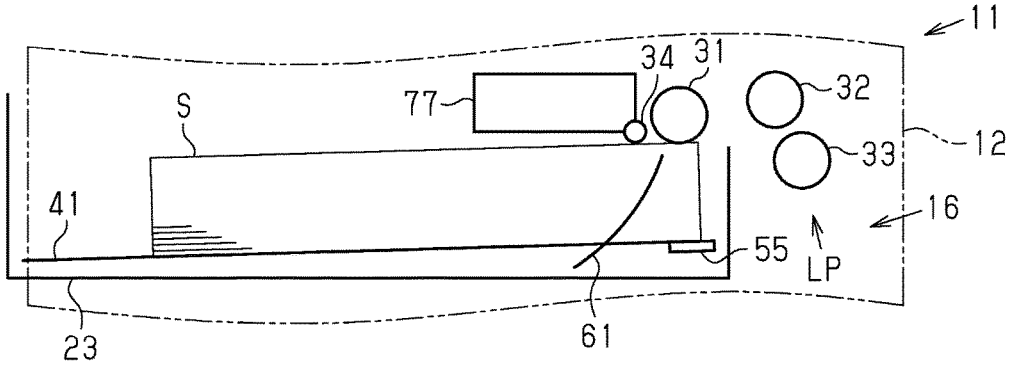
FIG. 20 is a perspective side view when the medium accommodating member accommodating a lot of mediums is pulled out.

As illustrated in FIG. 20, in a case in which the medium accommodating member 23 accommodates a lot of the mediums S, the medium S at the uppermost position in a bundle of the mediums S to be accommodated in the medium accommodating member 23 comes into contact with the pickup roller 31, and thus the hopper 41 is pressed down by a thickness of the bundle of the mediums S to be accommodated. In this state, when the medium accommodating member 23 is pulled out from the apparatus main body 12, while the hopper 41 is pressed down by the pickup roller 31 through the medium S, the edge portion 56 moves the front side in the depth direction without being in contact with the cam 61. Also, when the medium accommodating member 23 is further pulled out from the apparatus main body 12, if a distal end in the bundle of the mediums S to be accommodated is pulled out to a front side of the pickup roller 31 in a pulling-out direction, the medium S is not pressed to a lower side by the pickup roller 31, and the hopper 41 moves toward the upper side from a position in which the hopper is pressed down by the pickup roller 31 through the medium S. In this case, according to the amount of the medium S to be accommodated, there is a concern that the medium S which is pushed up by the hopper 41 may interfere with the other members such as the transmitting mechanism 75. Regarding this point, in the embodiment, when the pressing roller 34 on the front side of the pickup roller 31 in the pulling-out direction is provided, a concern that the medium S may interfere with the other member is reduced, even when the medium S is not pressed by the pickup roller 31 in a process in which the medium accommodating member 23 is pulled out from the apparatus main body 12.

Figure 21:
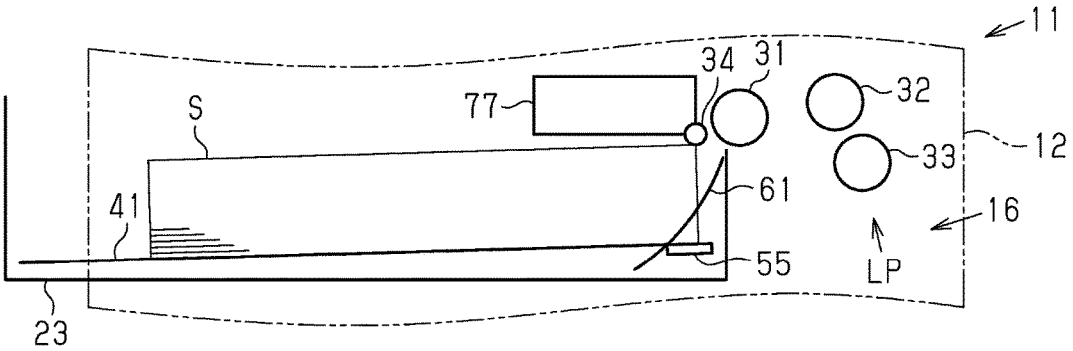
FIG. 21 is a perspective side view when the medium accommodating member is further pulled out from the state illustrated in FIG. 20.

As illustrated in FIG. 21, after the distal end of the bundle of the mediums S to be accommodated in the medium accommodating member 23 is pulled out to the front side of the pickup roller 31 in the pulling-out direction, the end portion on the downstream side in the transporting direction in the bundle of the mediums S comes into contact with the pressing roller 34, and thus the medium S which is biased upwardly by the hopper 41 is pressed. When the medium accommodating member 23 is further pulled out from the apparatus main body 12, in a state in which the bundle of the mediums S comes into contact with the pressing roller 34, the edge portion 56 of the hopper 41 comes into contact with the cam 61. Also, the hopper 41 moves toward the standby position WP by the cam 61 in accordance with the pulling-out of the medium accommodating member 23. That is, since the pressing roller 34 presses the medium S until the edge portion 56 of the hopper 41 comes into contact with the cam 61, and the hopper 41 is maintained at a pressing position, even when the medium accommodating member 23 accommodates a lot of the mediums S, a concern that the medium S may interfere with the other members is reduced.

According to the embodiment described above, effects as following can be obtained.

(1) At the time of pulling out the medium accommodating member 23 from the apparatus main body 12, the pickup roller 31 which presses the medium S from the lower side by the hopper 41 of the medium accommodating member 23 is reversely rotated according to the medium S pulled out in accordance with the pulling-out of the medium accommodating member 23. Therefore, the medium S pressed by the pickup roller 31 can be pulled out from the apparatus main body 12 with the medium accommodating member 23. Accordingly, a concern that the medium S may remain inside the apparatus main body 12 at the time of pulling out the medium accommodating member 23 can be reduced.

(2) The driving force of the driving source M is transmitted through the allowance 101 as an allowing portion which allows the pickup roller 31 to be rotated in the reverse rotating direction. Therefore, the pickup roller 31 is reversely rotated by the allowance 101 as the allowing portion, and thus a concern that the medium S may remain inside the apparatus main body 12 can be reduced.

(3) The allowance 101 as the allowing portion is provided on a connecting part of the driving gear 95 and the joint member 84. Therefore, compared to a case in which the allowance 101 as the allowing portion is provided inside the transmitting mechanism 75, a structure of the transmitting mechanism 75 can be easily formed.

(4) The cam 61 which displaces a position of the hopper 41 to the lower side is provided so as to come into contact with a part of the hopper 41 after the retard roller 33 is displaced to the non contacting position LP by the displacing mechanism 62 at the time of pulling out the medium accommodating member 23 from the apparatus main body 12. Accordingly, at the time of pulling out the medium accommodating member 23 from the apparatus main body 12, after the retard roller 33 is displaced to the non contacting position LP, the hopper 41 is displaced to the lower side toward the standby position. Therefore, in a stage in which the pinching of the medium S between the separating roller 32 and the retard roller 33 is released, the medium S is pressed against the pickup roller 31 by the hopper 41. That is, at the time of pulling out the medium accommodating member 23 from the apparatus main body 12, since the pickup roller 31 is reversely rotated in accordance with contacting of the medium S which is being moved by releasing the medium S pinched between the separating roller 32 and the retard roller 33, the medium S between the separating roller 32 and the retard roller 33 can be easily pulled out.

(5) The printing apparatus 11 is disposed on an opposite side of a side where the separating roller 32 and the retard roller 33 are positioned with respect to the pickup roller 31, and is provided with the pressing roller 34 which is capable of pressing the medium S pressed by the pickup roller 31 from the same side as the pickup roller 31. Also, regarding a distance between the hopper 41 and the roller 31 and a distance between the hopper 41 and the roller 34 present at the feeding position, the distance of the pressing roller 34 is longer than that of the pickup roller 31. Therefore, in a case in which a lot of the mediums S are accommodated in the medium accommodating member 23, at the time of pulling out the medium accommodating member 23 from the apparatus main body 12, even when the medium S is deviated from the pickup roller 31 in a direction where the medium accommodating member 23 is attached or detached, the medium S is not pressed against the pickup roller 31, and the medium S is pressed against the pressing roller 34. Accordingly, at the time of pulling out the medium accommodating member 23, a concern that the medium S which is pushed up by the hopper 41 may come into contact with the other members such as the transmitting mechanism 75 can be reduced. Also, in a state in which the medium accommodating member 23 is mounted, the pressing roller 34 is separated from the medium S, and thus, at the time of feeding the medium S at the uppermost position, a contacting friction resistance of the medium S received from the pressing roller 34 is not present, or the contacting friction resistance can be reduced if the roller comes into contact with the medium.

Also, the embodiment described above may be modified as follows.

The allowance 101 as the allowing portion may be provided inside the transmitting mechanism 75. For example, the allowance may be provided in a part in which the second spur gear 79 and the third spur gear 80 are engaged with each other. In addition, a plurality of the allowances 101 may be provided.

The pickup roller 31 is not limited to a configuration in which the pickup roller is attached to the apparatus main body 12 through the transporting unit 71, and may be configured to be directly attached to the apparatus main body 12.

The driving gear 95 may be disposed so as not to be engaged with the second gear 94. That is, a mechanism for rotating the separating roller 32 may be separately provided.

The hopper 41 may be provided to move between two position of the feeding position SP and the standby position WP by being electrically controlled.

The displacing mechanism 62 may be configured to displace the retard roller 33 between the two positions of the contacting position CP and the non contacting position LP by being electrically controlled.

The engagement projection 85 may have a cylindrical shape or a prismatic shape.

The engagement projection 96 may have a cylindrical shape or a prismatic shape.

The printing apparatus may be a liquid ejecting apparatus which performs printing by ejecting or discharging fluid (including liquid, liquid-form bodies in which particles of a functional material are dispersed or mixed in liquid, fluid-form bodies such as gels, and a solid which can be ejected by flowing in a fluid form) other than ink. For example, the printing apparatus may be a liquid-form body ejecting apparatus which performs printing by ejecting liquid-form bodies including a material such as an electrode material or a coloring material (pixel material) used for manufacturing a liquid crystal display, an electroluminescence (EL) display, and a surface emitting display in a form of dispersion or dissolution. In addition, the printing apparatus may be a fluid-form body ejecting apparatus which ejects fluid-form bodies such as gel (for example, physical gel), or a grain and powder ejecting apparatus (for example, toner jet type recording apparatus) which ejects a solid, for example, powder (powder or granular material) such as a toner. Also, the invention can be applied to any one of fluid ejecting apparatuses. Also, in this specification, "fluid" includes, for example, liquid (including inorganic solvent, organic solvent, solution, liquid resin, liquid-formed metal (molten metal), and the like), liquid-form bodies, fluid-form bodies, and grain powder (including grain and powder).

The entire disclosure of Japanese Patent Application No. 2016-254411, filed Dec. 27, 2016 is expressly incorporated by reference herein.

What is claimed is:

1. A printing apparatus comprising:

an apparatus main body;

a printing unit that performs printing on a medium;

a medium accommodating member that is detachably provided in the apparatus main body and is capable of accommodating the medium;

a first roller that is provided in the apparatus main body, and picks up the medium from the medium accommodating member by being brought in contact with the medium which is accommodated in the medium accommodating member mounted in the apparatus main body and being driven to rotate;

a second roller that is provided in the apparatus main body, is disposed on a downstream side of the first roller in a transporting direction of the medium, and is brought into contact with the medium picked up by the first roller on the same surface as a surface with which the first roller comes into contact and is driven to rotate;

a third roller that is provided in the apparatus main body, and is brought into contact with the medium picked up by the first roller on a surface opposite to the surface with which the first roller comes into contact and is rotated following the second roller;

a driving source of the first roller and the second roller; and a displacing mechanism that displaces a position of the third roller with respect to the second roller depending on attaching and detaching of the medium accommodating member to and from the apparatus main body, wherein the medium accommodating member includes a hopper which is movable between a feeding position in which the medium to be accommodated is pressed to the first roller by a pressing force of a pressing member and a standby position in which the medium is separated from the first roller against the pressing force of the pressing member, wherein the displacing mechanism displaces the third roller to a contacting position in which the third roller is capable of coming into contact with the second roller when the medium accommodating member is mounted in the apparatus main body, and displaces the third roller to a non contacting position in which the third roller is separated from the second roller when the medium accommodating member is pulled out from the apparatus main body, and wherein the first roller is rotatable in a reverse rotating direction opposite to a rotating direction of the driven rotation due to the frictional force with the pulled out medium in accordance with the pulling-out of the medium accommodating member under a circumstance in which the medium is pressed by the hopper present at the feeding position.

2. The printing apparatus according to claim 1, wherein a driving force of the driving source is transmitted through an allowing portion which allows the first roller to be rotated in the reverse rotating direction.

3. The printing apparatus according to claim 2, further comprising:

a transmitting mechanism that includes a first engaging portion for transmitting the driving force of the driving source to the first roller; and a gear that includes a second engaging portion which is engaged with the first engaging portion and transmits the driving force of the driving source to the first roller, wherein the allowing portion is a gap in the rotating direction of the gear when the first engaging portion and the second engaging portion are engaged with each other.

4. The printing apparatus according to claim 3, wherein the apparatus main body includes a cam which displaces the hopper toward the standby position against a biasing force of the biasing member by a part of the hopper coming into contact with the cam when the medium accommodating member is pulled out from the apparatus main body, and wherein the cam is provided so that the part of the hopper comes into contact with the cam after the third roller is displaced to a non contacting position by the displacing mechanism when the medium accommodating member is pulled out from the apparatus main body.

5. The printing apparatus according to claim 4, further comprising:

a fourth roller that is disposed closer to a side where the medium accommodating member is pulled out than the first roller, and is capable of coming into contact with the medium biased by the hopper on the same surface as the surface with which the first roller comes in contact, wherein a distance in a vertical direction from a part in which the medium comes into contact with the fourth roller to a bottom wall of the medium accommodating member is longer than a distance in the vertical direction from a part in which the medium comes into contact with the first roller to the bottom wall.

* * * * *